US007089903B2

(12) United States Patent
Fujii et al.

(10) Patent No.: US 7,089,903 B2
(45) Date of Patent: Aug. 15, 2006

(54) VIBRATION CONTROL ARRANGEMENT FOR INTERNAL COMBUSTION ENGINES

(75) Inventors: Noriaki Fujii, Wako (JP); Akiyuki Yonekawa, Wako (JP); Katsunori Nakamura, Wako (JP); Keiko Yoshida, Wako (JP); Masaki Nagakura, Wako (JP); Tomoya Fujimoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/086,658

(22) Filed: Mar. 23, 2005

(65) Prior Publication Data

US 2005/0211197 A1 Sep. 29, 2005

(30) Foreign Application Priority Data

Mar. 24, 2004 (JP) ..... P 2004-085993
Jan. 25, 2005 (JP) ..... P 2005-016302

(51) Int. Cl.
*F16C 9/00* (2006.01)

(52) U.S. Cl. ..... 123/195 R; 384/429; 384/434; 384/440

(58) Field of Classification Search ..... 123/195 R, 123/195 C, 198 E
See application file for complete search history.

(56) References Cited

U.S. PATENT DOCUMENTS 3,089,735 A * 5/1963 Mann ..... 384/429
3,832,747 A * 9/1974 Nankivell et al. ..... 470/2
4,793,876 A * 12/1988 Mitani ..... 148/436
5,024,813 A * 6/1991 Nishiyama ..... 420/402
5,976,709 A * 11/1999 Kageyama et al. ..... 428/614
2001/0024018 A1* 9/2001 Teranishi et al. ..... 277/594
2004/0007344 A1* 1/2004 Nakamura ..... 164/98

FOREIGN PATENT DOCUMENTS

DE 4122123 A1 * 1/1993
JP 55028349 A * 2/1980
JP 05332339 A * 12/1993
JP 6-185522 7/1994
KR 2001053989 A * 7/2001
KR 2002062715 A * 7/2002

* cited by examiner

*Primary Examiner*—Noah P. Kamen
(74) *Attorney, Agent, or Firm*—Armstrong, Kratz, Quintos, Hanson & Brooks, LLP

(57) ABSTRACT

In an internal combustion engine including a valve actuating mechanism, a vibration control member made of vibration control alloy is interposed in a path of vibration transmission between a camshaft and a cylinder head. The vibration control alloy has a vibration isolation capability comparable to that of rubber, but provides a durability and a resistance to degradation comparable to those of metal and alloy that are typically used in internal combustion engines. Therefore, a desired vibration control can be achieved while ensuring a required reliability, durability and resistance to degradation. The present invention is particularly useful when the valve actuating mechanism is provided with a variable lift, variable timing or variable compression mechanism because such a variable mechanism increases the stress to the engine, and tends to cause more vibrations than a more conventional non-variable valve actuating mechanism.

12 Claims, 23 Drawing Sheets

VIBRATION CONTROL ARRANGEMENT FOR INTERNAL COMBUSTION ENGINES

TECHNICAL FIELD

The present invention relates to a vibration control arrangement for internal combustion engines, and in particular to a vibration control arrangement that is effective in reducing the transmission of vibrations from vibration sources in the valve actuation system and/or piston-crank system of an internal combustion engine.

BACKGROUND OF THE INVENTION

The valve actuation system of an internal combustion engine for opening and closing intake valves and exhaust valves typically uses rocker arms that are each provided with a cam engagement portion for engaging a cam formed on a camshaft and a valve engagement portion for engaging the stem end of a valve. The camshaft is rotatably supported by a cam holder provided on the cylinder head, and a rocker arm shaft that rotatably supports the rocker arm is fixed to the cam holder. In such a valve actuating mechanism, vibrations that are produced as a result of actuation of the valve are transmitted to the outside, and are emitted as noises. In particular, when variable mechanisms such as variable valve lift mechanism, variable valve timing mechanism, a variable compression ratio mechanism, etc. is used, the adjusting mechanism tends to apply an additional stress to various parts of the engine, and the vibration problems often become even more acute. The vibrations are transmitted via at least two paths. Firstly, the vibrations owing to the collision between the valve and the valve engagement portion of the rocker arm are transmitted to the cam holder via the rocker arm. Secondly, the vibrations owing to the collision between the cam and cam engagement portion of the rocker arm are transmitted to the cam holder via the rocker arm or camshaft. In either case, the vibrations transmitted to the cam holder are emitted to the atmosphere via the cylinder head, head cover and so on, and turn into noises.

The crankshaft system comprises a connecting rod that transmits the reciprocating movement of the piston, a crankshaft that converts the movement transmitted from the connecting rod into a rotational movement, and a bearing that rotatably supports the journal of the crankshaft. In the case of the crankshaft system, the vibrations transmitted from the connecting rod to the crankshaft and bearing are converted into noises.

Conventionally, the transmission of vibrations from vibration sources to various components was controlled by using vibration control material such as rubber and plastic in the path of vibration transmission from the vibrations sources in the valve actuating mechanism and crankshaft system and thereby attenuating the transmission of vibrations from the vibration sources to the various components. Such a prior attempt at reducing vibrations and noises in internal combustion engines is disclosed, for instance, in Japanese patent laid open publication 6-185522.

However, the vibration control material such as rubber and plastic has a poor resistance to deformation and prone to degradation as compared with metallic material such as an aluminum alloy which is typically used in various components of the engine.

BRIEF SUMMARY OF THE INVENTION

In view of such problems of the prior art, a primary object of the present invention is to provide a vibration control arrangement for internal combustion engines that are both effective and durable.

A second object of the present invention is to provide a vibration control arrangement for internal combustion engines that are both effective and economical.

A third object of the present invention is to provide a vibration control arrangement for internal combustion engines that would not impair the performance of the engine and is reliable is use.

According to the present invention, these and other objects can be accomplished by providing a vibration control arrangement for a valve actuating mechanism of an internal combustion engine, the valve actuating mechanism comprising a cam holder fixedly attached to a cylinder head and a camshaft formed with a cam for actuating an engine valve rotatably supported by the cam holder, wherein: a vibration control member made of vibration control alloy is interposed in a path of vibration transmission between the camshaft and the cylinder head.

The vibration control alloy has a vibration isolation capability comparable to that of rubber, but provides a durability and a resistance to degradation comparable to those of metal and alloy that are typically used in internal combustion engines. Therefore, a desired vibration control can be achieved while ensuring a required reliability, durability and resistance to degradation. The present invention is particularly useful when the valve actuating mechanism is provided with a variable lift, variable timing or variable compression mechanism because such a variable mechanism increases the stress to the engine, and tends to cause more vibrations than a more conventional non-variable valve actuating mechanism.

BRIEF DESCRIPTION OF THE DRAWINGS

Now the present invention is described in the following with reference to the appended drawings, in which.

DETAILED DESCRIPTION OF THE PREFERRED EMBODIMENTS

The present invention is characterized by the fact that the parts of an engine valve system or crankshaft system that would transmit vibrations from vibration sources are made of vibration control alloy to effectively attenuate the transmission of vibrations. In the case of a valve actuating mechanism, the vibrations are typically produced as a result of impulsive contacts between each cam and the cam follower part of a corresponding rocker arm and between the valve stem of each valve and the valve stem engaging part of the corresponding rocker arm. In the case of a crankshaft system, as the combustion occurs and the resulting pressure pushes a piston, the plays that may be present in the path of power transmission between the piston and a crankshaft are impulsively closed, and this produces vibrations in various parts of the path of power transmission.

The vibration control alloy as used in this application includes, not exclusively, Mn—Cu and Fe—Al vibration control alloys. For instance, the vibration control alloy marketed by Daido Steel, Co., Ltd. of Japan under the tradename of M2052 can be used as such a material. These alloys are provided with mechanical strengths that are comparable to those of aluminum alloys and steels that are commonly used in the valve actuating mechanism and crankshaft system of an engine, but demonstrate a vibration control capability comparable to that of rubber or other elastomeric material. These alloys have thermal expansion coefficients similar to those of common aluminum alloys and steels, and allow clearances between various parts to be maintained within prescribed tolerances. The vibration control alloys that can be used in the present invention are not limited to those mentioned above, but may include other vibration control alloys as long as they have required mechanical strengths and vibration control capabilities.

Figure 1:
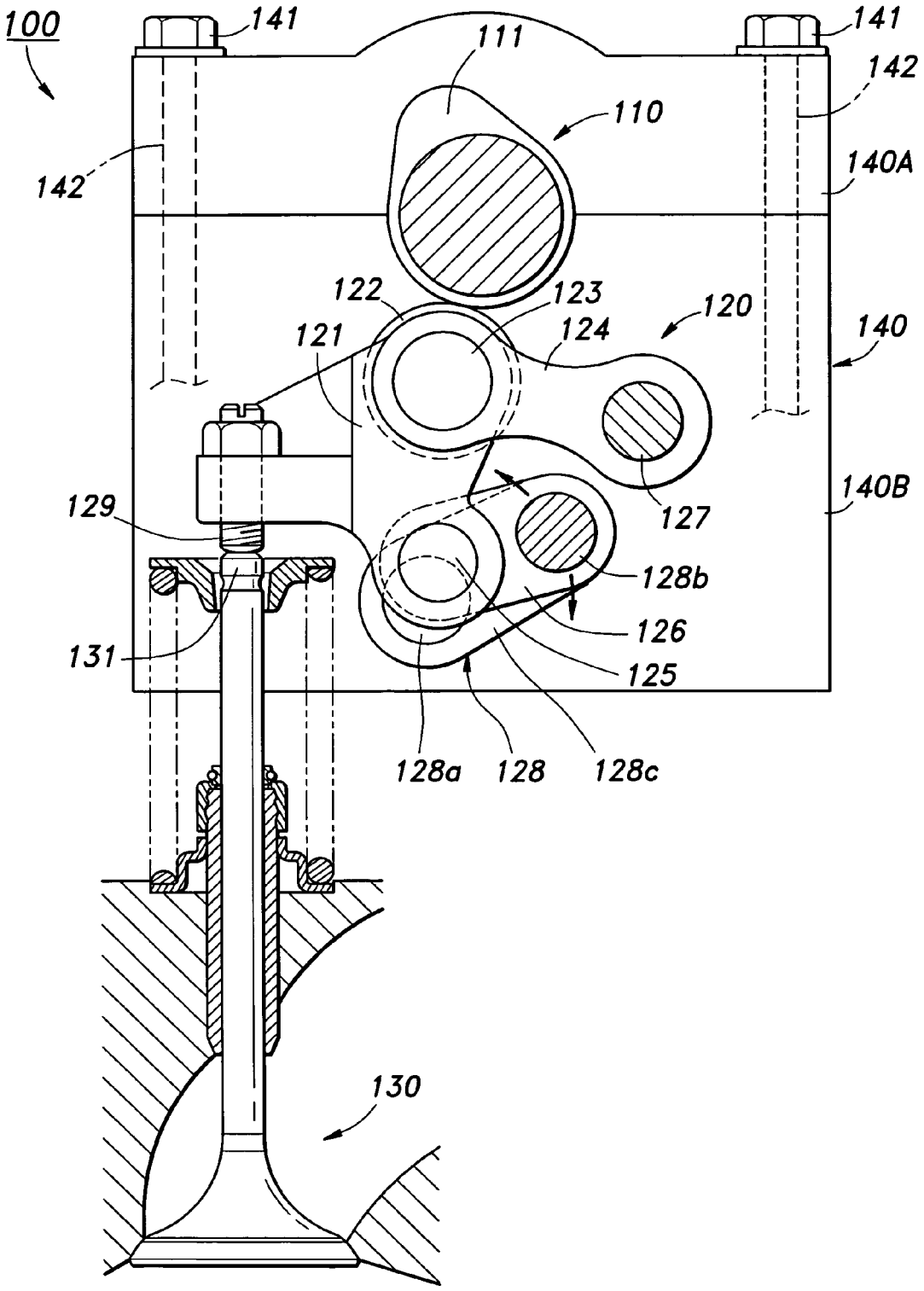
FIG. 1 is a simplified sectional view showing a valve actuating mechanism 100 to which the present invention is applied.
Figure 2:
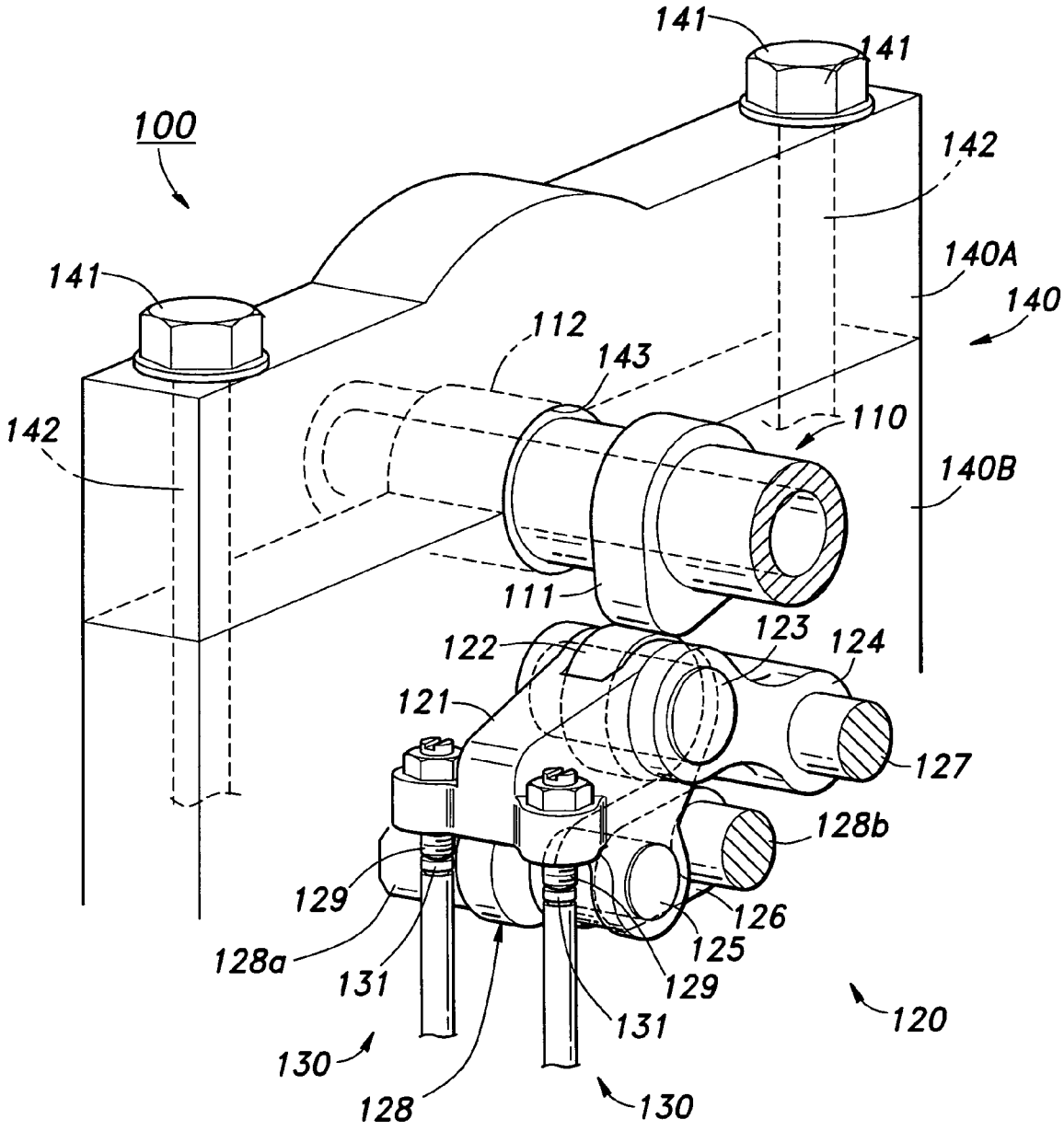
FIG. 2 is an enlarge perspective view of an essential part of FIG. 1.

Embodiments of the present invention as applied to the valve actuating mechanism of an internal combustion engine are described in the following with reference to FIGS. 1 to 7. FIGS. 1 and 2 show the outline of the valve actuating mechanism 100 to which the present invention is applied.

The valve actuating mechanism 100 comprises a camshaft 110 integrally formed with a cam 111 and a variable valve lift mechanism 120 that opens and closes a valve 130 of the engine in dependence on the rotational angle of the cam 111. Although the camshaft 110 is typically provided with a plurality of cams 111, only one of them is referred to in the disclosure to simplify the description. The camshaft 110 is rotatably supported on a cam holder 140 provided on the cylinder head of the engine.

The camshaft 110 rotates in synchronism with a crankshaft of the engine not shown in the drawings, and the rotation of the camshaft 110 is transmitted to the rocker arm 121 via the cam 111 integrally formed on the camshaft 110. The camshaft 110 is provided with a journal 112 rotatably supported by a bearing bore 143 of the cam holder 140.

The variable valve lift mechanism 120 comprises a plurality of members 121 to 129. The member 121 consists of a rocker arm that angularly reciprocates in dependence on the rotation of the cam 111. The rocker arm 121 transmits the rotation of the cam 111 to the valve 130, and is provided with an upper part and lower part that are each bifurcated. The rocker arm 121 is also fitted with an adjust bolt 129 which engages a stem end 131 of the valve 130.

The upper bifurcated part of the rocker arm 121 is provided with a roller follower 122 that engages the cam 111 and is also connected to an end of an upper link 124 via an upper pin 123. The lower bifurcated part of the rocker arm 121 is connected to an end of a lower link 126 via a lower pin 125. The other end of the upper link 124 is pivotally connected to a rocker arm shaft 127 fixed to the cam holder 140, and the other end of the lower link 126 is pivotally connected to a crank pin 128*b* of a crank member 128 that includes a crank web 128*c* that integrally joins the crank pin 128*b* to a crank journal 128*a* of the crank member 128. The crank pin 128*b* of the crank member 128 can be rotatively actuated around the crank journal 128*a* by an actuator not shown in the drawings.

In this variable valve lift mechanism 120, as the cam 111 of the camshaft 110 rotates and engages the roller follower 122, the rocker arm 121 is angularly actuated around both the upper pin 123 and lower pin 125, and opens the valve 130. At this time, if the crank member 128 is actuated by the actuator into a rotational movement around the crank journal 128*a*, the position of the crank pin 128*b* changes as indicated by arrows in FIG. 1, and this movement of the center of the rotational movement of the rocker arm 121 causes a change in the lift of the valve 130. For details of this variable valve lift mechanism 120, reference should be made to Japanese patent application No. 2002-19687 or 2003-157774 filed by the assignee of this application.

The cam holder 140 is attached to the cylinder head not shown in the drawings by using a pair of threaded bolts 141. For this purpose, the cam holder 140 is formed with holes 142 for receiving these mounting bolts 141. The cam holder 140 defines the bearing bore 143 for rotatably supporting the journal 112 of the camshaft 110. The cam holder 140 consists of two halves, or an upper cam holder 140A and a lower cam holder 140B, so as to jointly define the bearing bore 143. The cam holder 140 or, in particular, the lower cam holder 140B is provided with a support hole 144 (FIG. 3) for supporting the rocker arm shaft 127, and a receiving hole 145 (FIG. 3) for rotatatively receiving the crank journal 128*a*.

Figure 3:
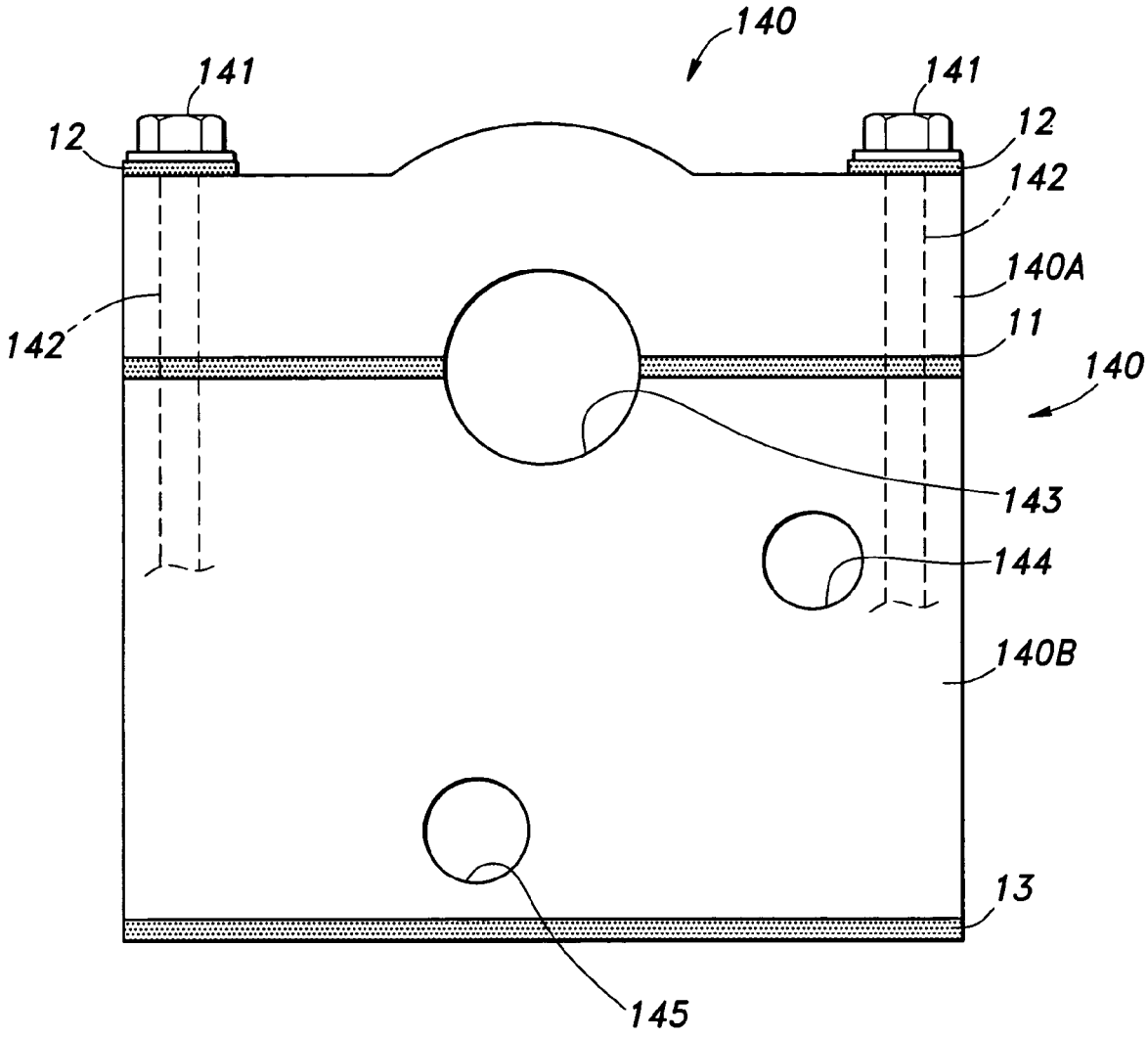
FIG. 3 is a view similar to FIG. 1 showing the cam holder that includes various parts made of vibration control members.

FIG. 3 shows vibration control alloy members 11, 12 and 13 made of vibration control alloy that are used in the parts to which vibrations are transmitted from the vibrations sources of the cam holder 140. FIG. 3 shows only an essential part of FIG. 1.

As shown in FIG. 3, the parting plane of the upper cam holder 140A is defined by a vibration control alloy member 11 having a prescribed thickness. In other words, the part of the upper cam holder 140A that contacts the lower cam holder 140B is entirely covered by the vibration control alloy member 11. Also, the parts that provide seats for the heads of the mounting bolts 141 are each formed with vibration control alloy members 12. In other words, the parts of the upper cam holder 140A engaging the heads of the mounting bolts 141 are covered with the vibration control alloy members 12.

Owing to this structure, the vibrations that are transmitted from the rocker arm 121 to the upper cam holder 140A are attenuated by the vibration control member 11, and the vibrations that are transmitted from the mounting bolts 141 to the upper cam holder 140A are attenuated by the vibration control members 12.

Similarly, as shown in FIG. 3, the end of the lower cam holder 140B abutting the cylinder head not shown in the drawing (the lower end in FIG. 3) is formed with a vibration control member 13 having a prescribed thickness. In other words, the part of the lower cam holder 140B that abuts the cylinder head is covered by the vibration control member 13.

Owing to this structure, the vibrations that are transmitted from the lower cam holder 140B to the cylinder head are attenuated by the vibration control member 13, and the transmission of vibrations from the lower cam holder 140B to the cylinder head can be effectively controlled. The vibrations that are transmitted from the lower cam holder 140B to the cylinder head means the vibrations that are transmitted from the rocker arm 121 to the lower cam holder 140B and then to the cylinder head.

Figure 4:
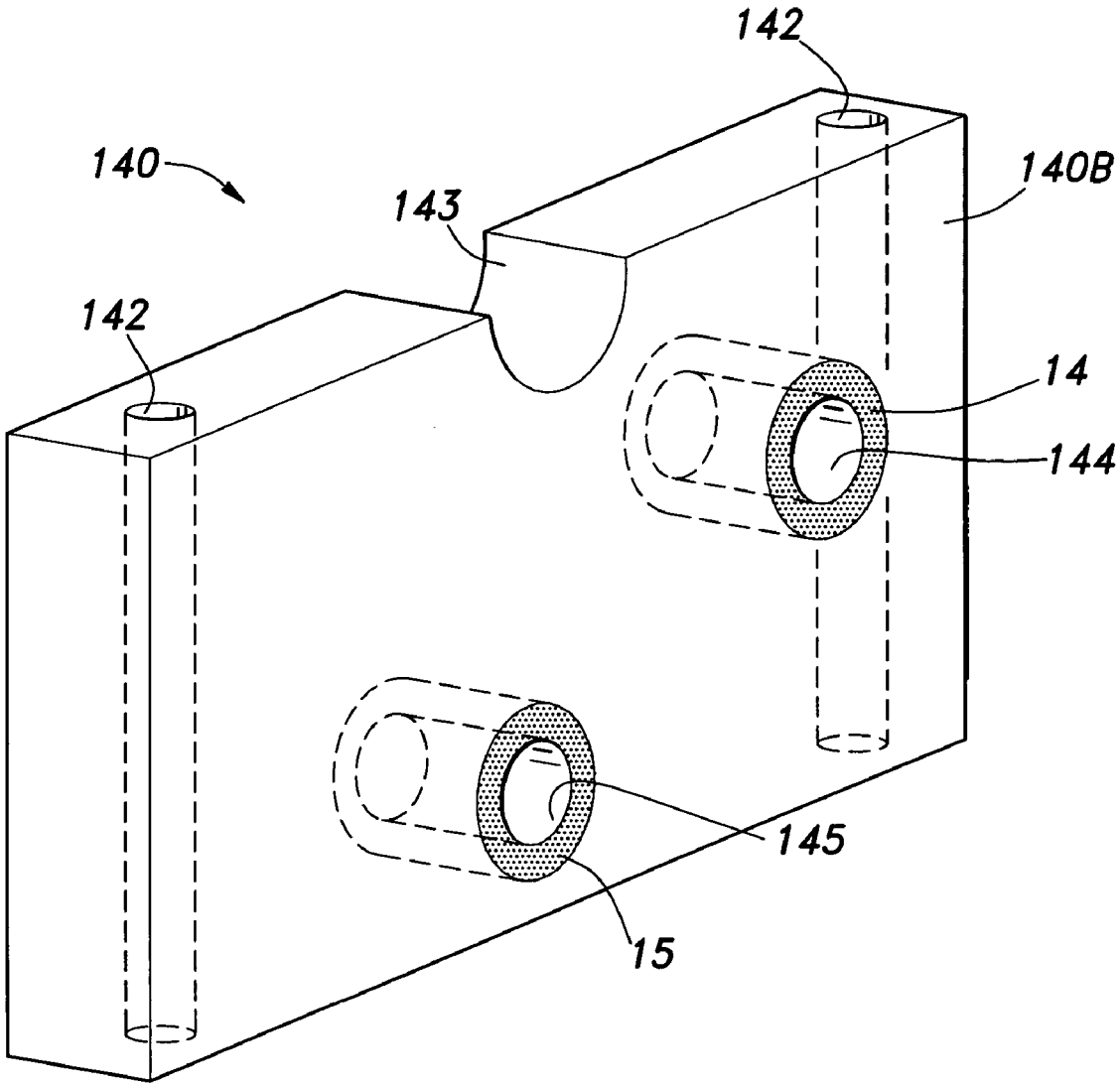
FIG. 4 is a view similar to FIG. 2 showing the lower cam holder that includes various parts made of vibration control member.

FIG. 4 shows a case where vibration control alloy members 14 and 15 are formed as cylindrical bushes, each having a prescribed thickness, that define the inner circumferential surfaces of the support hole 144 and receiving hole 145, respectively. FIG. 4 shows an essential part of FIG. 1, and omits the variable valve lift mechanism 120.

As shown in FIG. 4, the inner circumferential surface of the support hole 1445 supporting the rocker arm shaft 127 (see FIG. 2) in the lower cam holder 140B is defined by the bush or vibration control alloy member 14. In other words, the part of the lower cam holder 140B engaging the rocker arm shaft 127 is covered by the vibration control alloy member 14.

Owing to this structure, the vibrations that are transmitted from the rocker arm shaft 127 to the lower cam holder 140B are attenuated by the vibration control alloy member 14. Therefore, the transmission of vibrations from the rocker arm shaft 127 to the lower cam holder 140B can be controlled. The vibrations that are transmitted from the rocker arm shaft 127 to the lower cam holder 140B are vibrations that are transmitted from the rocker arm 121 (see FIG. 2) to the upper link 124 (see FIG. 2) and then to the rocker arm shaft 127.

As shown in FIG. 4, the inner circumferential surface of the receiving hole 145 receiving the crank journal 128*a* (see FIG. 2) in the lower cam holder 140B is defined by the bush or vibration control alloy member 15. In other words, the part of the lower cam holder 140B engaging the crank journal 128*a* is covered by the vibration control alloy member 15.

Owing to this structure, the vibrations that are transmitted from the crank journal 128*a* to the lower cam holder 140B are attenuated by the vibration control alloy member 15. Therefore, the transmission of vibrations from the crank journal 128*a* to the lower cam holder 140B can be controlled. The vibrations that are transmitted from the crank journal 128*a* to the lower cam holder 140B are vibrations that are transmitted from the rocker arm 121 (see FIG. 2) to the lower link 126 (see FIG. 2).

Figure 5:
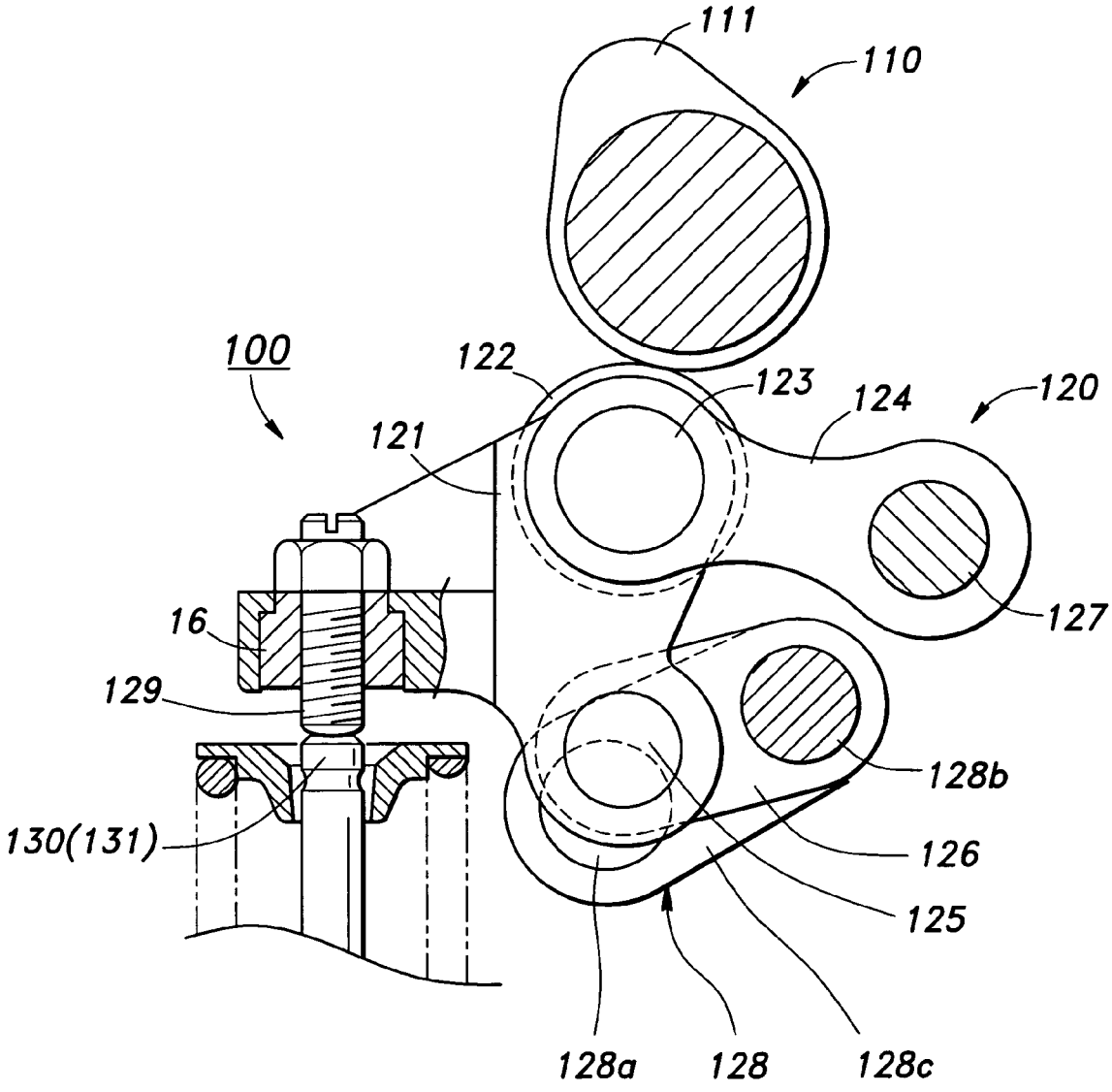
FIG. 5 is an enlarged sectional view showing the variable valve lift mechanism 120.

FIG. 5 shows a case where a part of the rocker arm 121 retaining the base end of the adjust bolt 129 is formed with a vibration control alloy member 16. FIG. 5 is an enlarged view of a part of the variable valve lift mechanism 120 illustrated in FIG. 1.

As shown in FIG. 5, the part of the rocker arm 121 retaining the base end of the adjust bolt 129 is formed with a vibration control alloy member 16 having a prescribed thickness. In other words, the part that retains the adjust bolt 129 is covered by the vibration control alloy member 16.

Owing to this structure, the vibrations that are transmitted from the adjust bolt 129 to the rocker arm 121 as the adjust bolt 129 collides with the stem end 131 of the valve 30 are attenuated by the vibration control alloy member 16. Therefore, the transmission of vibrations from the adjust bolt 129 to the rocker arm 121 can be controlled.

The variable valve lift mechanism 120 illustrated in FIGS. 1 and 2 can continually vary the lift of the valve 130 by moving the crank pin 128*b* and changing the position of the rotational center of the rocker arm 121 by using the actuator. Therefore, in this variable valve lift mechanism 120, as the rotational center of the rocker arm 121 moves, the moment acting upon the rocker arm 121 changes significantly. Therefore, the contact load between the cam 111 and valve 130 also changes significantly, and this causes an increase in vibrations. However, because the part through which the vibrations from the source of vibrations transmit is made of a vibration control alloy, a significant part of the vibrations can be attenuated.

Figure 6:
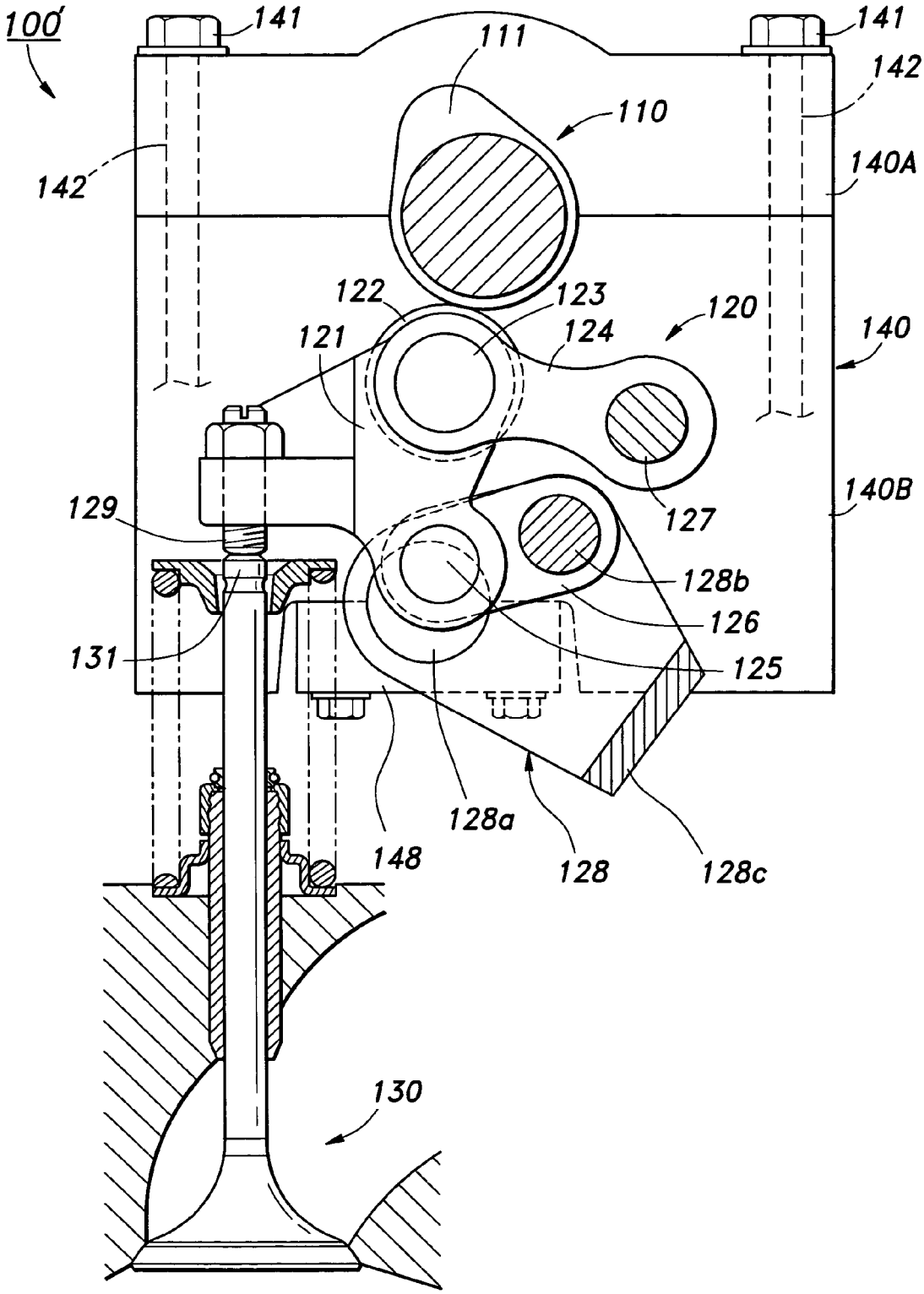
FIG. 6 is a simplified sectional view showing another valve actuating mechanism 100' to which the present invention is applied.
Figure 7:
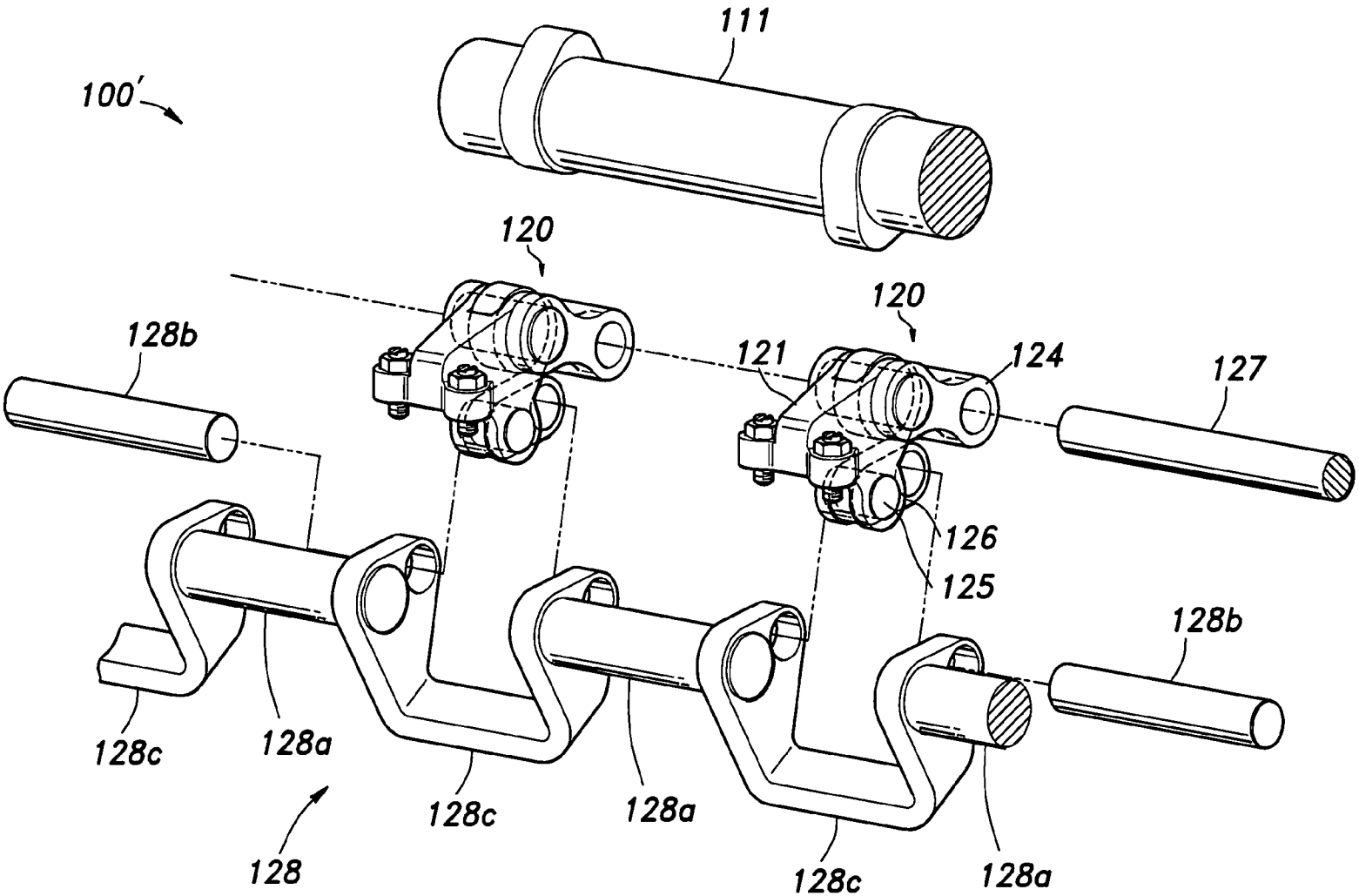
FIG. 7 is an exploded perspective view of the valve actuating mechanism 100'.
Figure 8:
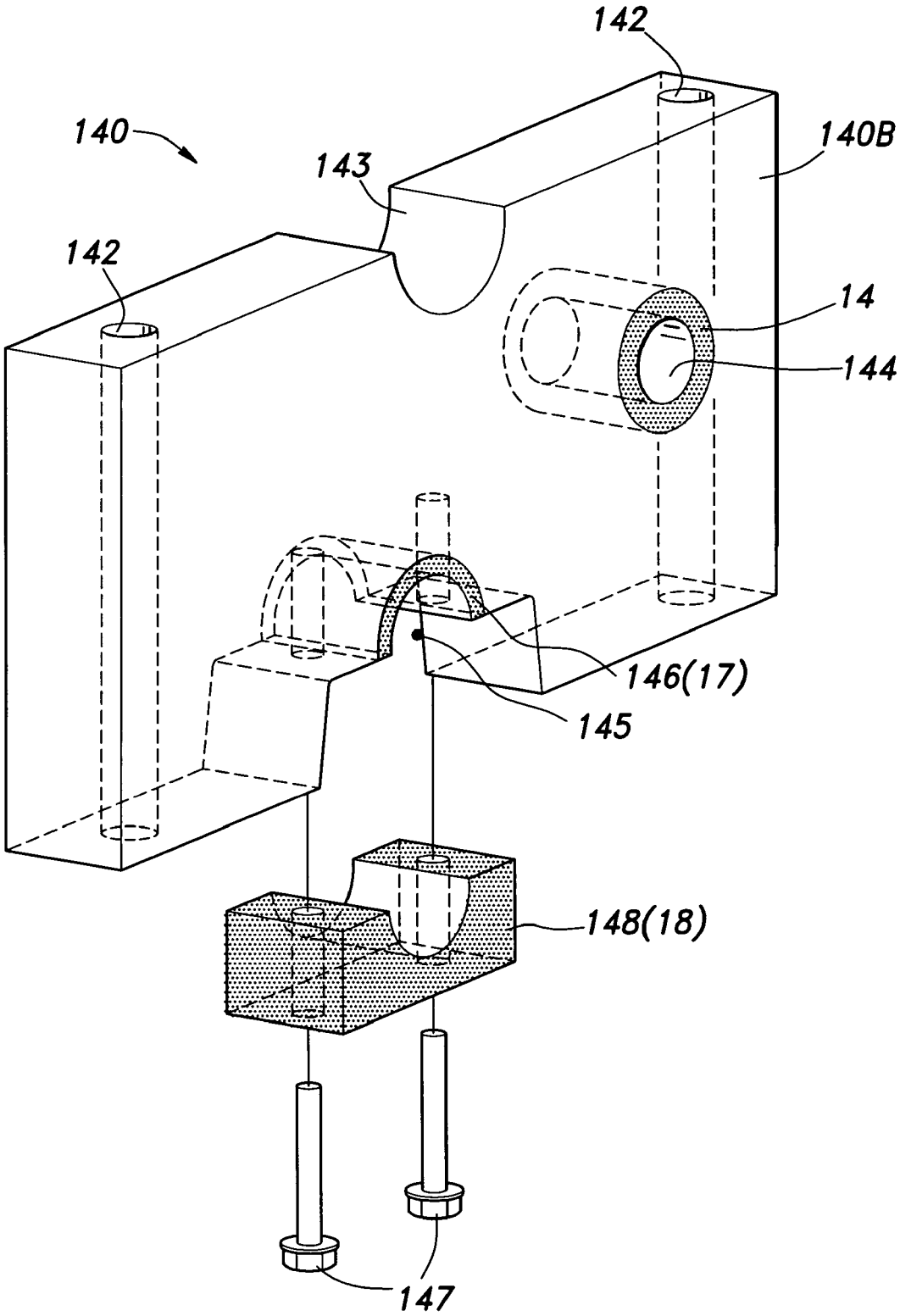
FIG. 8 is an exploded perspective view showing a part of FIG. 6.

FIGS. 6 to 8 show another embodiment of the present invention that is applied to a somewhat different valve actuating mechanism 100'. This valve actuating mechanism 100' is similar to that shown in FIGS. 1 to 5, but different in the structure of the crank member 128 and the way it is supported. In this valve actuating mechanism 100', the crank member 128 is shared by the variable valve lift mechanisms 120 of different cylinders. In other words, a single crank member 128 actuates a plurality of lower links 126. Therefore, each crank journal 128*a* connects the adjoining crank webs 128*c* to each other, and a crank pin 128*b* similarly extends between adjoining crank webs 128 in parallel with and adjacent to the corresponding crank journal 128*a*. Each crank pin 128*b* is connected to an end of a corresponding lower link 126.

Because of this structure, the crank journal 128*a* cannot be passed through the lower cam holder 140B from sideways as opposed to the valve actuating mechanism shown in FIGS. 1 to 5. Therefore, the lower cam holder 140B is provided with a recess in a middle part of a bottom end thereof, and the crank journal 128*a* is supported by an upper bearing portion 146 formed in this recess and a bearing cap 148 secured to the recess so as to define a bearing bore 145 for the crank journal 128*a* jointly with the upper bearing portion 146. The upper bearing portion 146 is made of a vibration control member 17, and the bearing cap 148 is also made of a vibration control member 18.

Owing to this structure, vibrations that are transmitted from the crank journal 128*a* to the lower cam holder 140B are attenuated by the vibration control members 17, 18. The vibrations that are transmitted from the crank journal 128*a* to the lower cam holder 140B are vibrations that are transmitted from the rocker arm 121 (See FIG. 6) to the lower link 126 (See FIG. 6).

Figure 9:
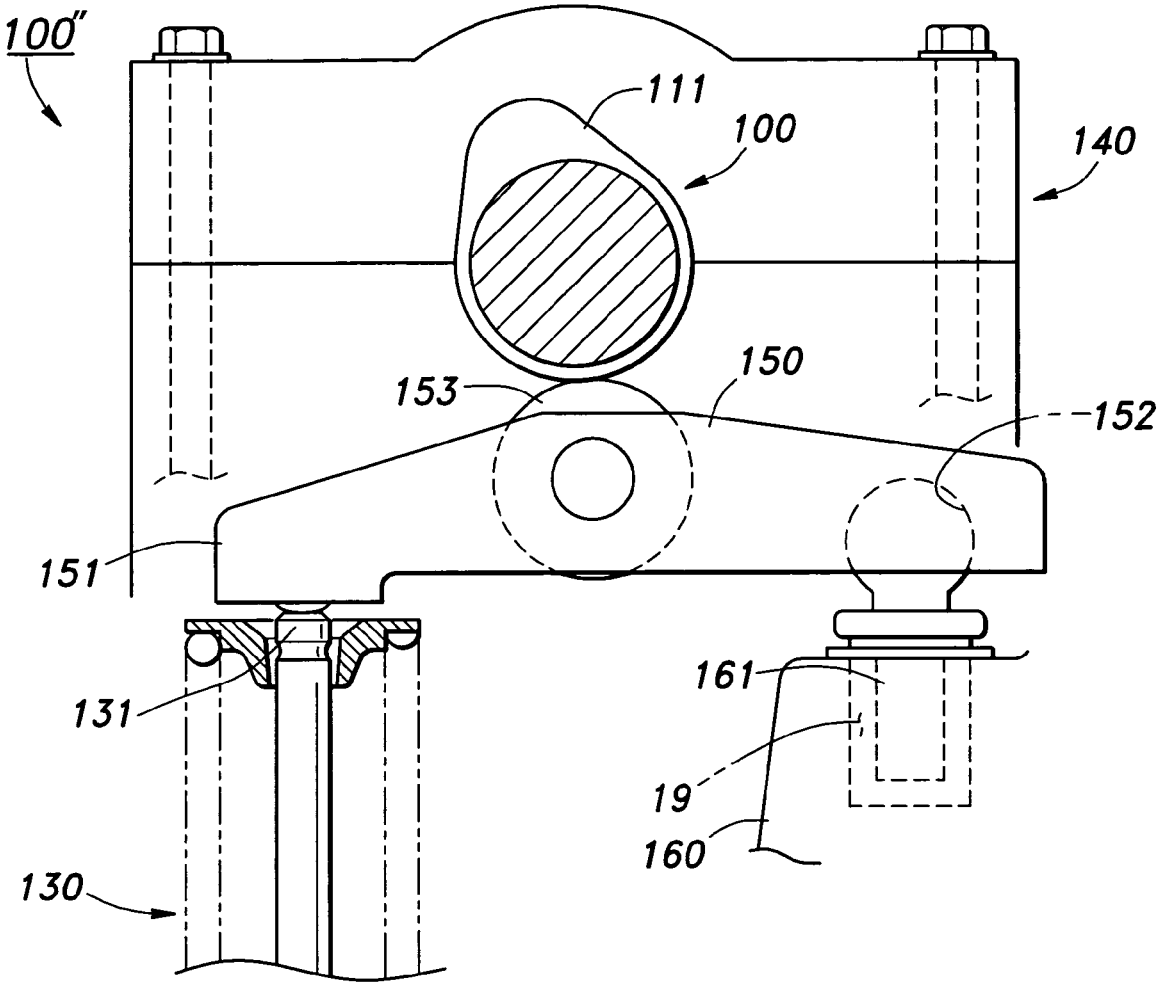
FIG. 9 is a side view showing yet another valve actuating mechanism 100" to which the present invention is applied.

FIG. 9 shows yet another embodiment of the present invention applied to a valve actuating mechanism 100"

somewhat different from that shown in FIGS. 1 to 5. This valve actuating mechanism 100" uses an oil tappet 161. In this embodiment, a part of the cylinder head 160 that retains the oil tappet 161 is made of a vibration control member 19. Otherwise, the valve actuating mechanism 100" is similar to that shown in FIGS. 1 to 5, and the parts corresponding to the previous embodiment are denoted with like numerals without repeating the description of such parts.

The valve actuating mechanism 100" illustrated in FIG. 9 comprises a rocker arm 150 that opens and closes a valve 130 in dependence on the rotation of the cam 111. One end of the rocker arm 150 is formed with a valve engaging portion 151 that engages a stem end 131 of the valve 130, and the other end of the rocker arm 150 is provided with an oil tappet socket 152 that receives a semi-spherical head of the oil tappet 161 retained in the cylinder head 160. The part of the cylinder head 160 retaining the base end of the oil tappet is made of a vibration control member 19. In other words, the base portion of the oil tappet 161 is covered by the vibration control member 19.

Owing to this structure, when the oil tappet socket 152 has pressed upon the head of the oil tappet 161, the resulting vibrations are transmitted from the oil tappet socket 152 to the head of the oil tappet 161, but are attenuated by the vibration control member 19. Therefore, the transmission of vibrations from the rocker arm 150 to the cylinder 160 can be effectively controlled.

Figure 10:
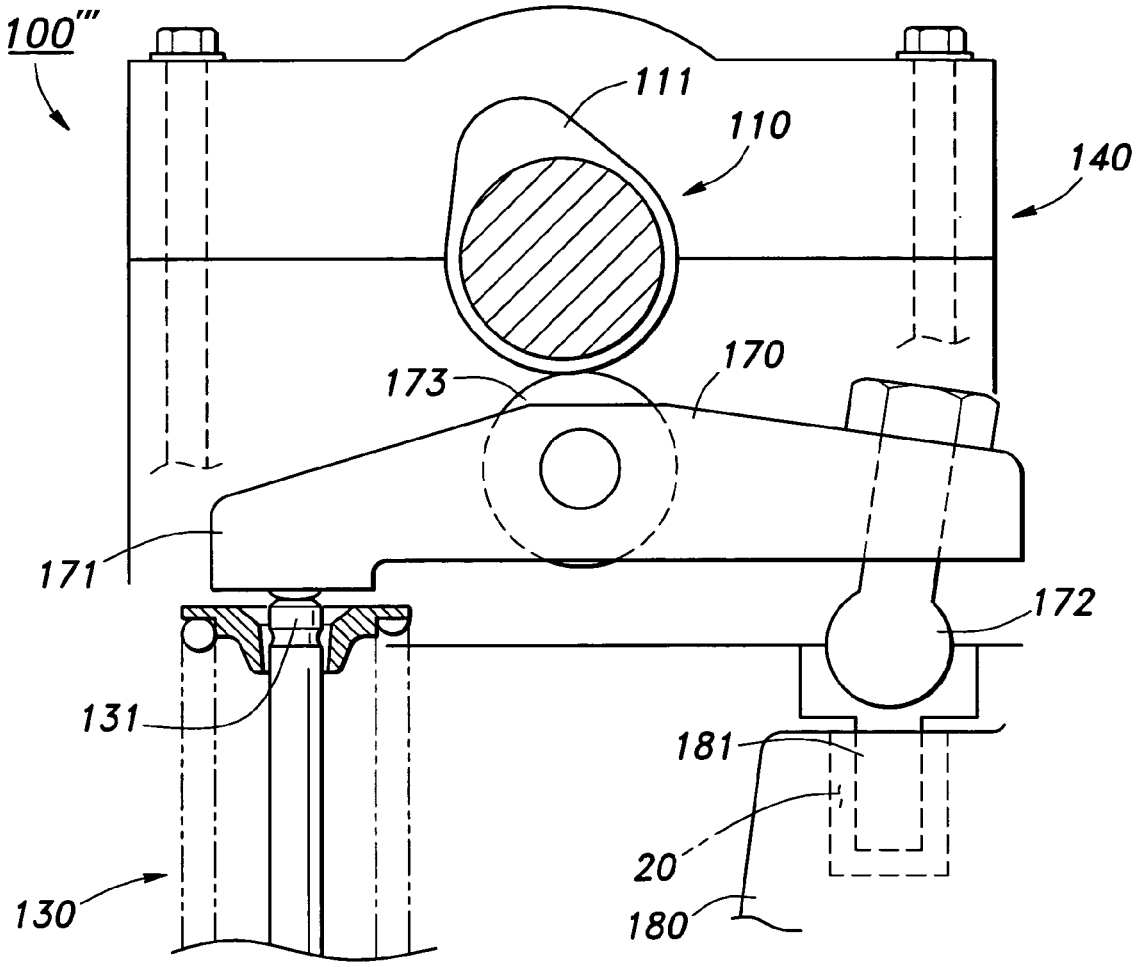
FIG. 10 is a side view showing a modification of the valve actuating mechanism 100" shown in FIG. 9.

FIG. 10 shows yet another embodiment of the present invention applied to a valve actuating mechanism 100'" somewhat different from that shown in FIG. 9. This valve actuating mechanism 100'" is similar to that shown in FIG. 9, but differs from it in the positioning of the oil tappet 161. In this embodiment, a tappet socket member 181 defining a socket for receiving a spherical head of an oil tappet 172 is retained by a member that is made of a vibration control member 20. Otherwise, the valve actuating mechanism 100'" is similar to that shown in FIG. 9, and the parts corresponding to the previous embodiment are denoted with like numerals without repeating the description of such parts.

The valve actuating mechanism 100'" illustrated in FIG. 10 comprises a rocker arm 170 that opens and closes the valve 130 in dependence on the rotation of the cam 111. One end of the rocker arm 170 is formed with a valve engaging portion 171 that engages a stem end 131 of the valve 130, and the other end of the rocker arm 170 is provided with an end pivot 172 consisting of a semi-spherical member that is received in the socket defined in the tappet socket member 181 retained by the cylinder head 180. The part of the cylinder head 180 that retains the socket member 181 is made of a vibration control member 20. In other words, the recess defined in the cylinder head 180 to retain the socket member 181 is covered by the vibration control member 20.

Owing to this structure, when the end pivot 172 hits the tappet socket member 181, the vibrations that are transmitted from the end pivot 172 to the tappet socket member 181 are attenuated by the vibration control member 20. Therefore, the transmission of vibrations from the rocker arm 170 to the cylinder head 180 can be effectively controlled.

Figure 11:
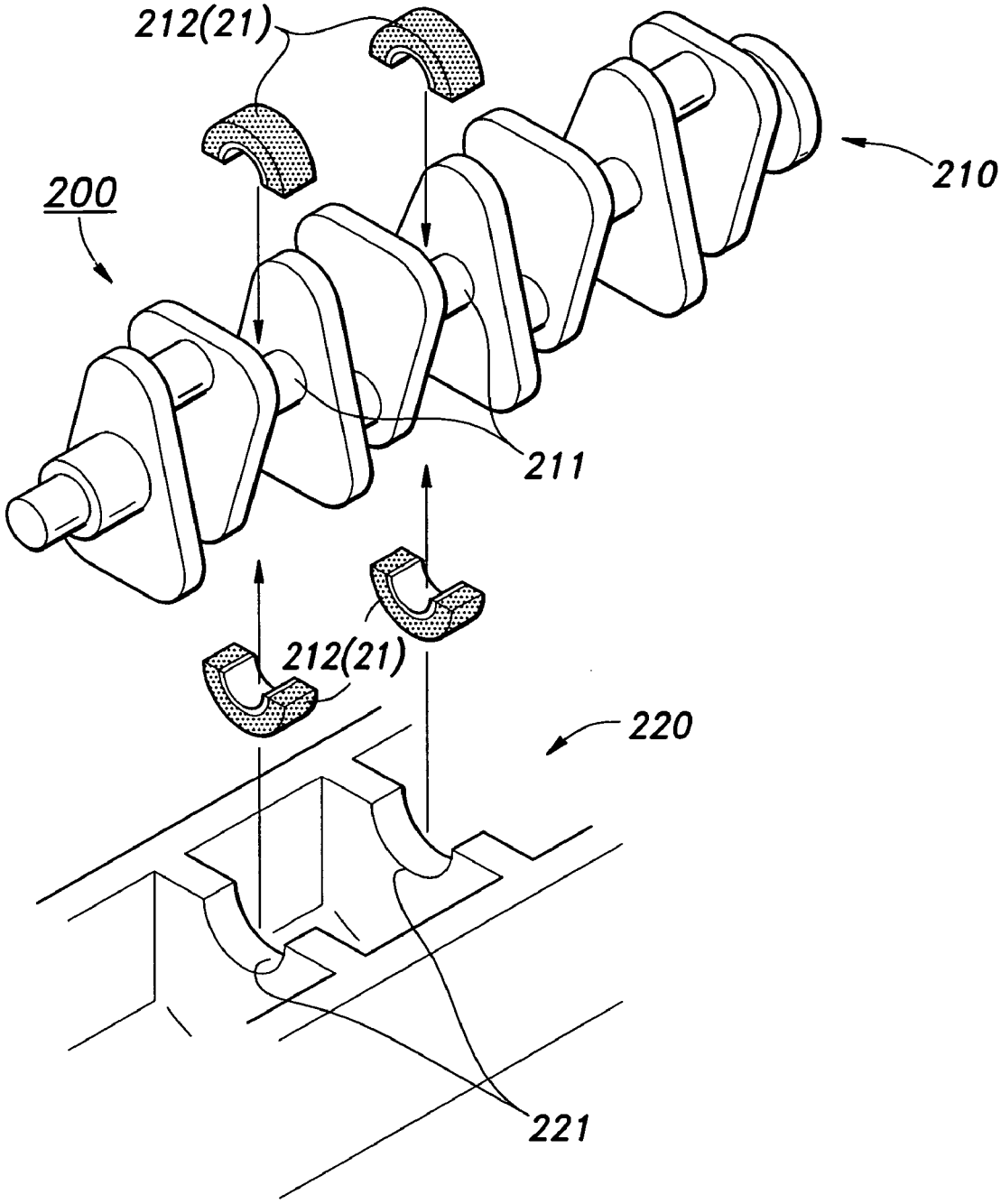
FIG. 11 is an exploded perspective view of a crankshaft system to which the present invention is applied.

FIG. 11 shows yet another embodiment of the present invention applied to a crankshaft system. The outline of the crankshaft system is now described with reference to FIG. 11 which is a simplified perspective view of a crankshaft system.

As shown in FIG. 11, the crankshaft system 200 comprises a crankshaft 210 which converts a reciprocating movement (movement of a piston in an internal combustion engine) transmitted by a connecting rod not shown in the drawing into a rotational movement, and bearings member 221 that each support a journal 211 of the crankshaft 210. Each bearing member 221 is semi-cylindrical in shape, and may be secured in position by using any conventional means or, alternatively, is integrally cast in the cylinder block 220. Each bearing member 221 may be provided with a liner that is made of metal or alloy having a lubricating property or steel. A pair of opposing bearings member 221 define a complete bearing for the corresponding journal 211.

In the illustrated embodiment, the bearing member 212 is made of a vibration control member 21. Because the bearing member 212 is made of the vibration control alloy, the vibrations that are transmitted from the journal 211 to the bearing member 212 are attenuated by the bearing member 212. Therefore, the transmission of vibrations from the journal 211 to the bearing members 221 can be favorably controlled. The vibrations that are transmitted from the journal 211 to the bearing members 221 are vibrations that are transmitted from a connecting rod not shown in the drawing to the crankshaft 211.

Figure 12:
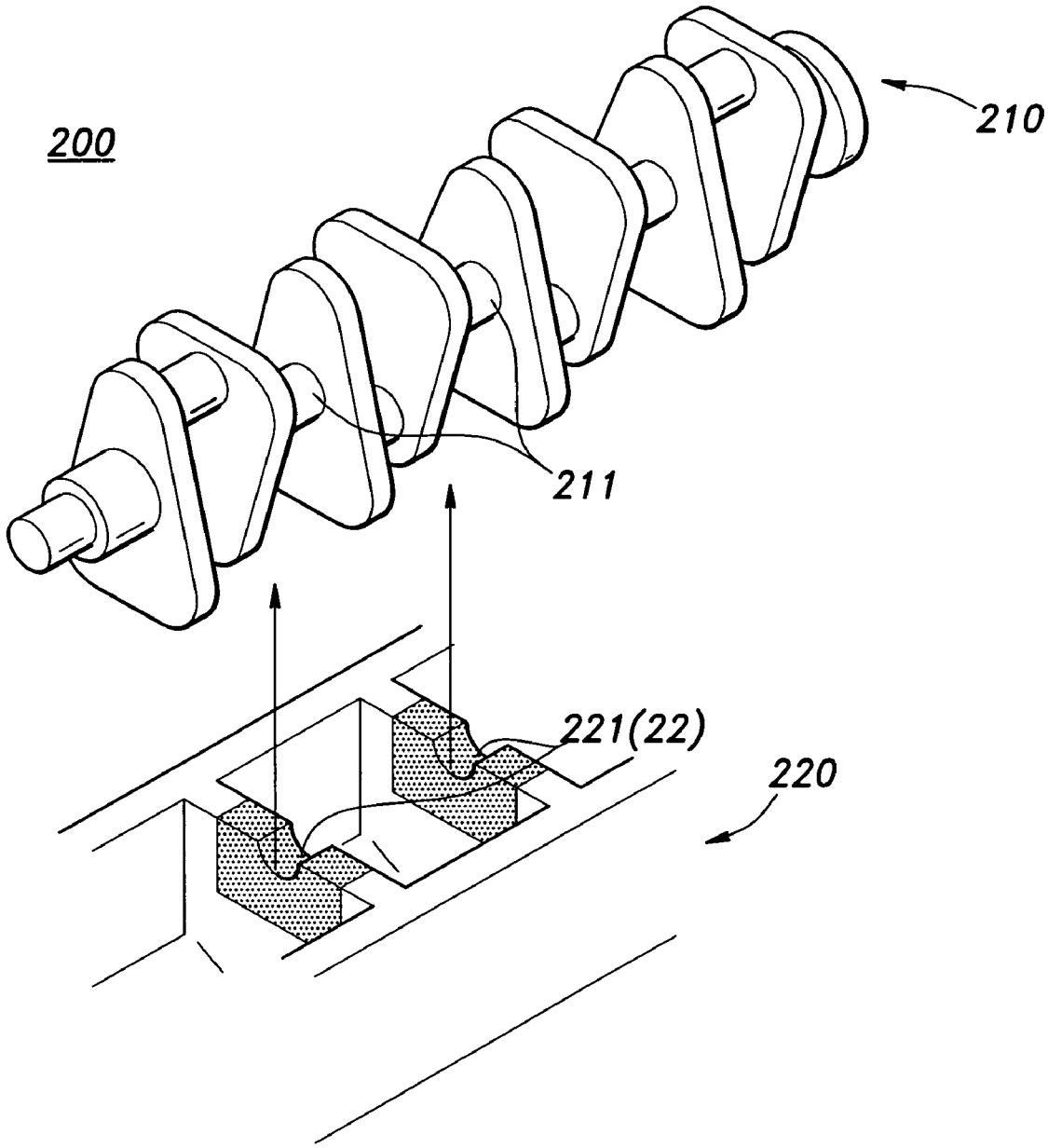
FIG. 12 is an exploded perspective view of a modified crankshaft system to which the present invention is applied.

FIG. 12 shows an embodiment in which the bearing member 221 is also integrally cast in the cylinder block 220, and the bearing member 221 is made of a vibration control alloy. The bearing member 221 in this case consists of a rectangular block defining a semi-cylindrical bearing surface. More specifically, the bearing member 221 is placed in the mold for casting the cylinder block 220, and is integrally joined to the cylinder block 220 as a result of the casting process.

Owing to this structure, the vibrations that are transmitted from the journal 211 to the cylinder block 220 via the bearing member 221 are attenuated by the vibration control member 22. Therefore, the transmission of vibrations from the journal 221 to the cylinder block 220 can be favorably controlled. The vibrations that are transmitted from the journal 211 to the cylinder block 220 are vibrations that are transmitted from the connecting rod not shown in the drawings to the crankshaft 210.

The vibration control arrangement of the present invention can also be applied to a variable lift valve actuating mechanism that comprises a plurality of rocker arms that provide different valve lifts and a means for selecting one of the rocker arms so that a desired valve lift may be achieved by selecting one of the rocker arms. In such a valve actuating mechanism, when different rocker arms are selected one after the other, large vibrations may be generated owing to the collision between the cam and rocker arm and between the rocker arm and valve. Therefore, by forming a part through which the vibrations from the vibration sources are transmitted with a vibration control member, vibrations that could be produced when changing one rocker arm to another can be attenuated, and the generation of large vibrations at such a time can be avoided.

Figure 13:
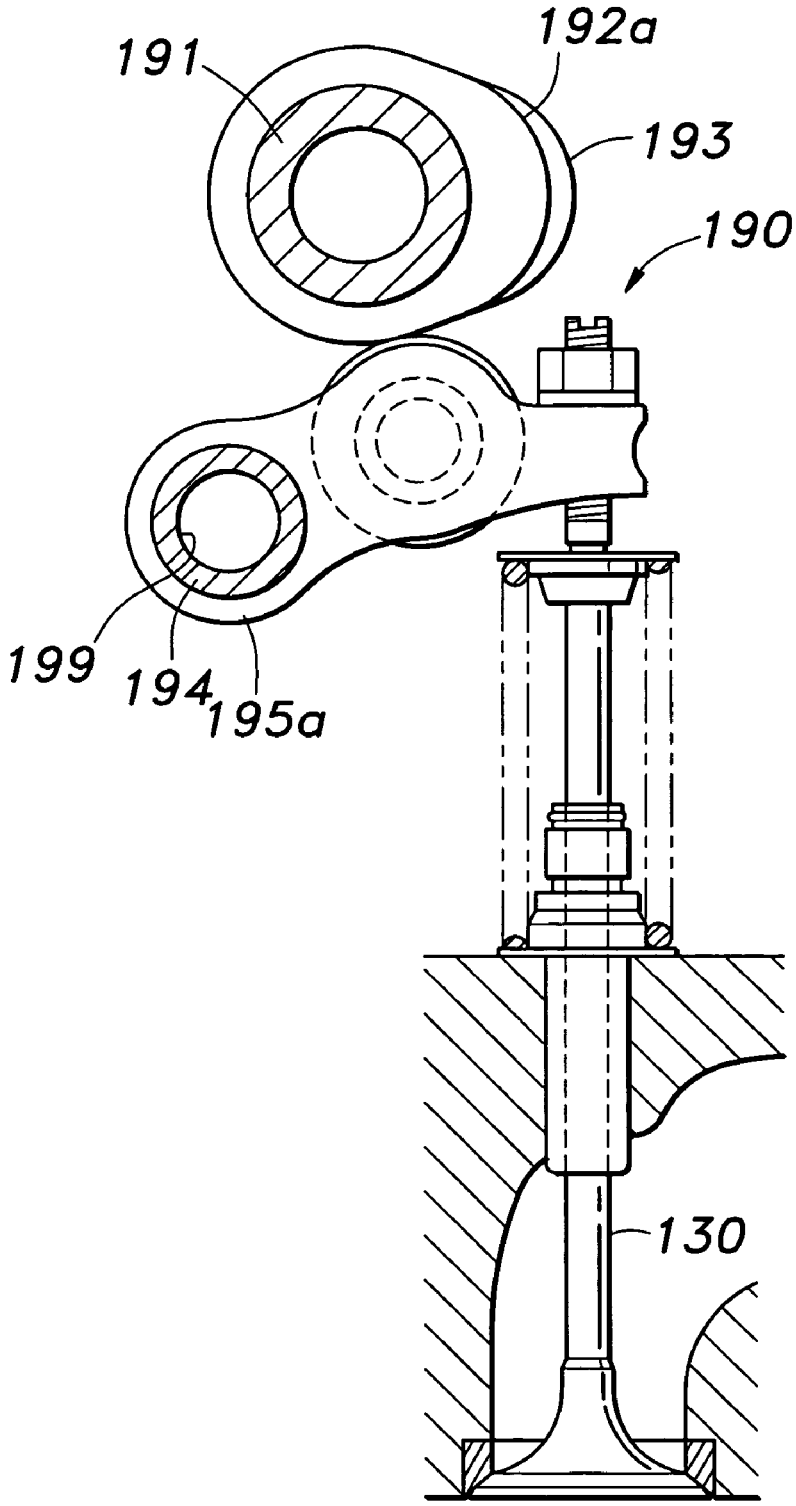
FIG. 13 is a sectional side view of a variable valve lift mechanism to which the present invention is applied.
Figure 14:
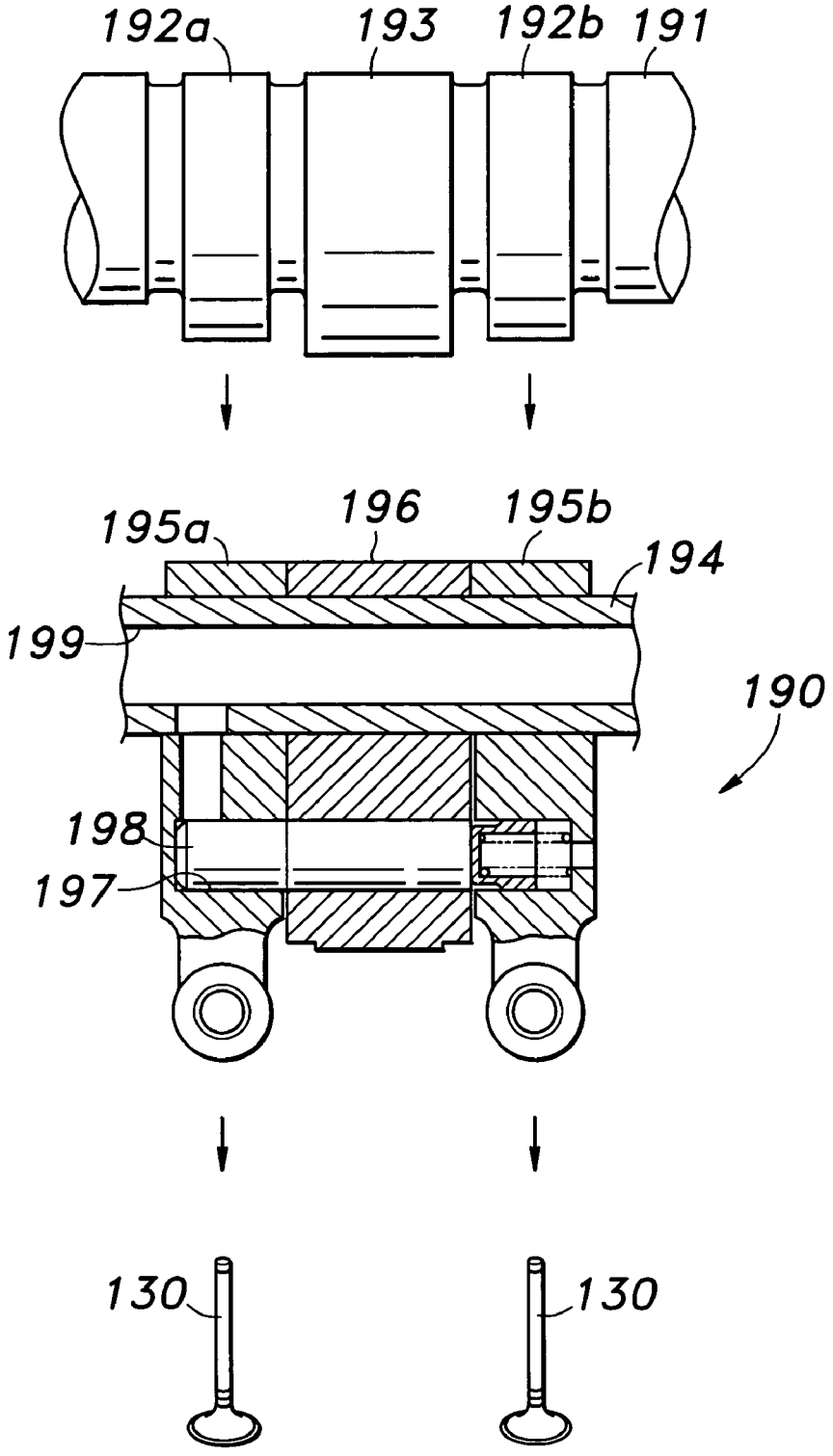
FIG. 14 is a plan view of the variable valve lift mechanism shown in FIG. 13.

Such a variable lift valve actuating mechanism 190 is illustrated in FIGS. 13 and 14. A camshaft 191 is provided with a pair of low speed cams 192*a*, 192*b* and a high speed cam 193. A rocker shaft 194 pivotally supports three rocker arms 195*a*, 195*b*, 196 one next to the other so as to correspond to the low speed cams 192*a*, 192*b* and high speed cam 193. A guide hole 197 is formed across the rocker arms 195*a*, 195*b*, 196 in parallel with the axial direction of the rocker shaft 194, and connecting pins 198 are received in the guide hole 197 to selectively engage and disengage the rocker arms with and from each other by selectively supplying oil pressure into an oil passage 199 that is defined inside the rocker shaft 194 and communicates with the guide hole 197. For details of this variable lift valve actuating mechanism, reference should be made to Japanese patent application No. 2000-388410.

The vibration control arrangement according to the present invention can also be applied to the big end of a connecting rod. In such a case, the bearing metal that is used at the big end of the connecting rod may be made of a vibration control member so as to attenuate the vibration that are transmitted from the piston to the connecting rod. Thereby, the transmission of the vibrations can be favorably controlled.

The present invention is also applicable to a variable compression ratio internal combustion engine. In such an engine, when a high compression ratio is selected, the engine is subjected to a relatively high load, and relatively large vibrations tend to be produced in the crankshaft system. Therefore, by using a vibration control member in the path of vibration transmission from a vibration source, the transmission of vibrations can be effectively controlled. For details of such a variable compression engine, reference should be made to Japanese patent laid open publication No. 2001-227367.

Figure 15:
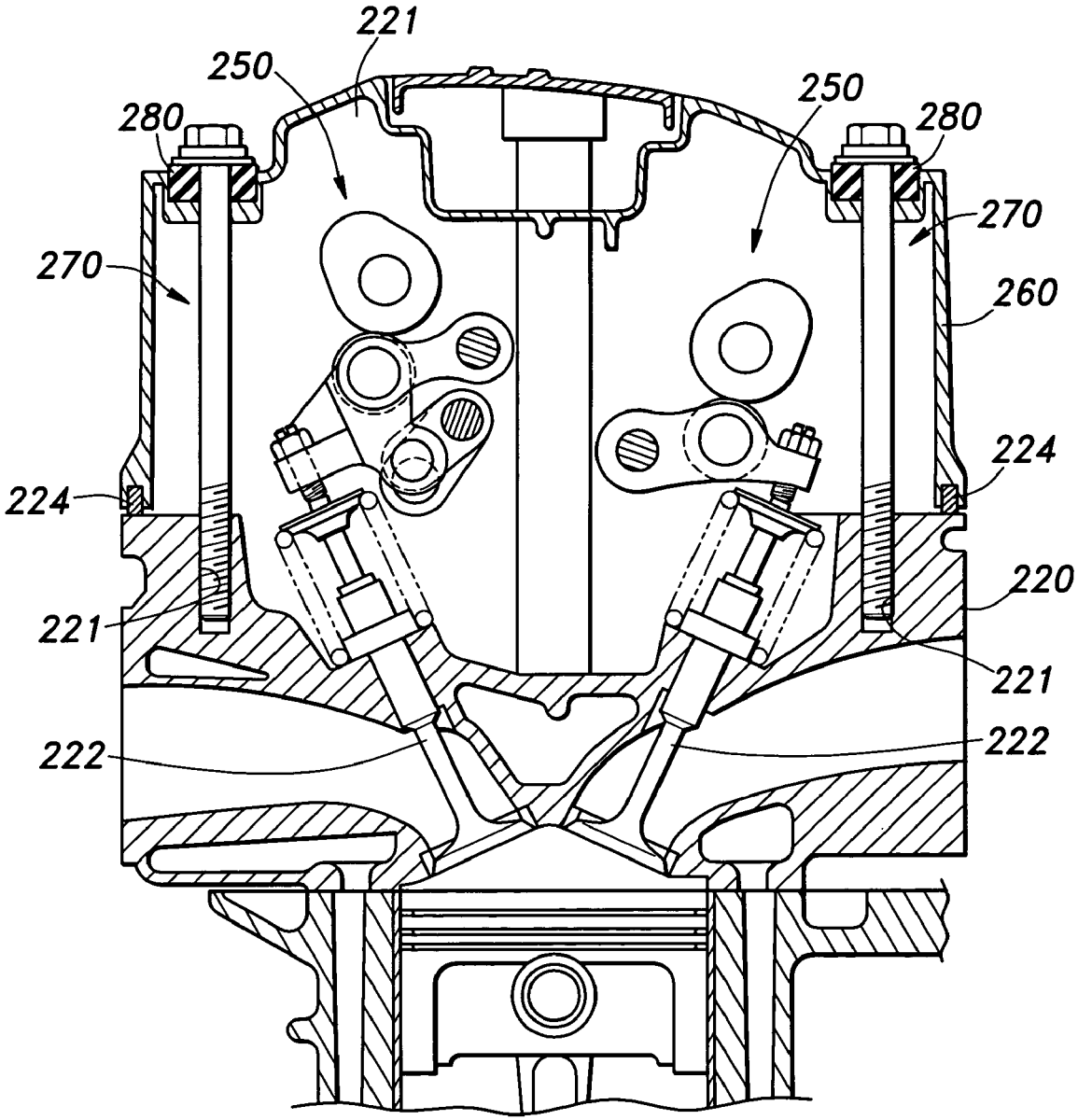
FIG. 15 is a sectional side view of a head cover arrangement according to the present invention.

FIG. 15 is a sectional view of a valve actuating mechanism. A valve chamber 221 defined between a cylinder head 220 and a head cover 260 accommodates a valve actuating mechanism 250 for actuating engine valves. The valve actuating mechanism 250 is mounted on the cylinder head 220 via a cam holder not shown in the drawings. The valve chamber 221 is filled with oil mist when the engine is operating, and a seal member 224 is interposed between the head cover 260 and cylinder head 220 to prevent leakage of such oil mist as well as oil which is normally present in the valve chamber 221 in liquid form. Numeral 222 denote engine valves.

The head cover 260 is secured in place by threaded bolts 270 that are passed through openings provided in the head cover 260 and threaded into threaded holes 221 formed in the cylinder head 220. An annular rubber bushing 280 is interposed between the head of each threaded bolt 270 and the opposing outer surface of the head cover 260. In this embodiment, each rubber bush 280 is received in a complementary recess defined on the exterior of the head cover 260. The rubber bushing 280 provides the function of damping and insulting vibrations as well as the function of providing a seal. If desired, the rubber bushing 280 may be replaced with a similar member made of vibration control alloy.

During the operation of the valve actuating mechanism 250, the vibrations produced from the valve actuating mechanism are transmitted to the head cover 260 via the mounting bolts 270. If there is any gap between the head cover 260 and mounting bolts 270, the head cover 260 may rattle, and it may cause noises. In particular, when the head cover 260 is not given with an adequate rigidity, there is a greater tendency to produce noises.

In the embodiment illustrated in FIG. 15, the mounting bolts 270 are made of vibration control alloy. The vibration control alloy that forms the mounting bolts is preferably given with a vibration attenuation ratio of 0.05% or more, and is provided with similar mechanical properties as soft steel. Thus, by forming the mounting bolts with vibration control members, the vibrations transmitted from the cylinder head are attenuated in the head cover, and this significantly contributes to the reduction in noises.

In the embodiment illustrated in FIG. 15, the annular seal member 224 is made of a vibration control alloy that is preferably given with an attenuation ratio of 0.05% or more. By thus forming the annular seal member 224 with a vibration control member, the transmission of vibrations from the cylinder head 220 to the head cover 260 can be minimized and the generation of noises is minimized as a result. Because the vibration control member is substantially more durable than rubber or other elastomeric material, no gap is created between the seal member and cylinder head even after an extended period of time. This ensures a required sealing capability and prevents rattling of the head cover. As a result, it becomes possible to mount a component such as a rotational angle sensor that requires a high positional precision on the head cover.

If desired, the head cover may be made of vibration control alloy while the annular seal member is made of rubber or other elastomer.

Figure 16:
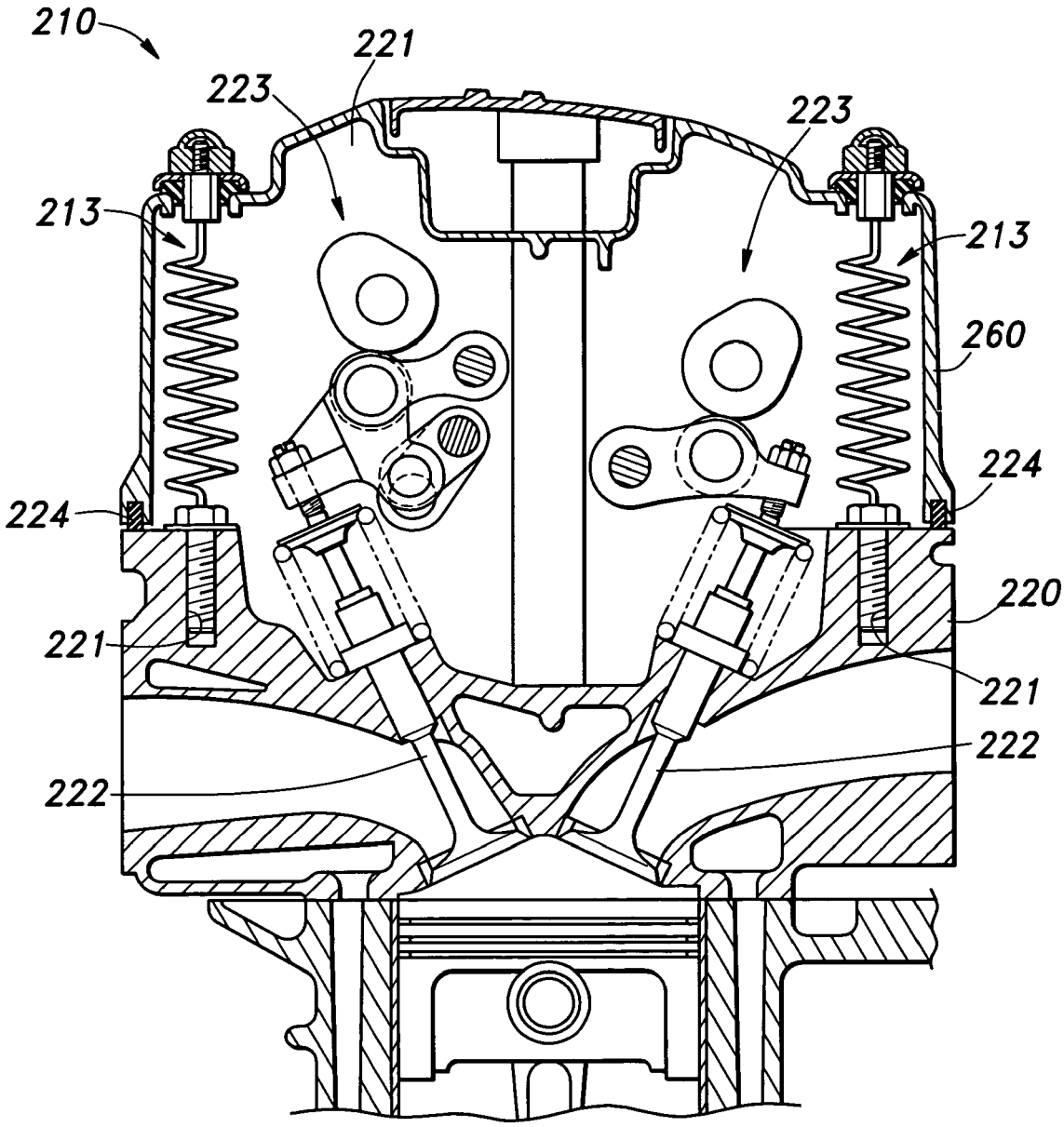
FIG. 16 is a view similar to FIG. 15 showing a modified embodiment of the present invention.

FIG. 16 shows a modified embodiment of the present invention which is similar to the embodiment illustrated in FIG. 15, but differs from the previous embodiment in that the mounting bolts are replaced by fastening members 210 that are essentially made of coil springs.

Figure 17:
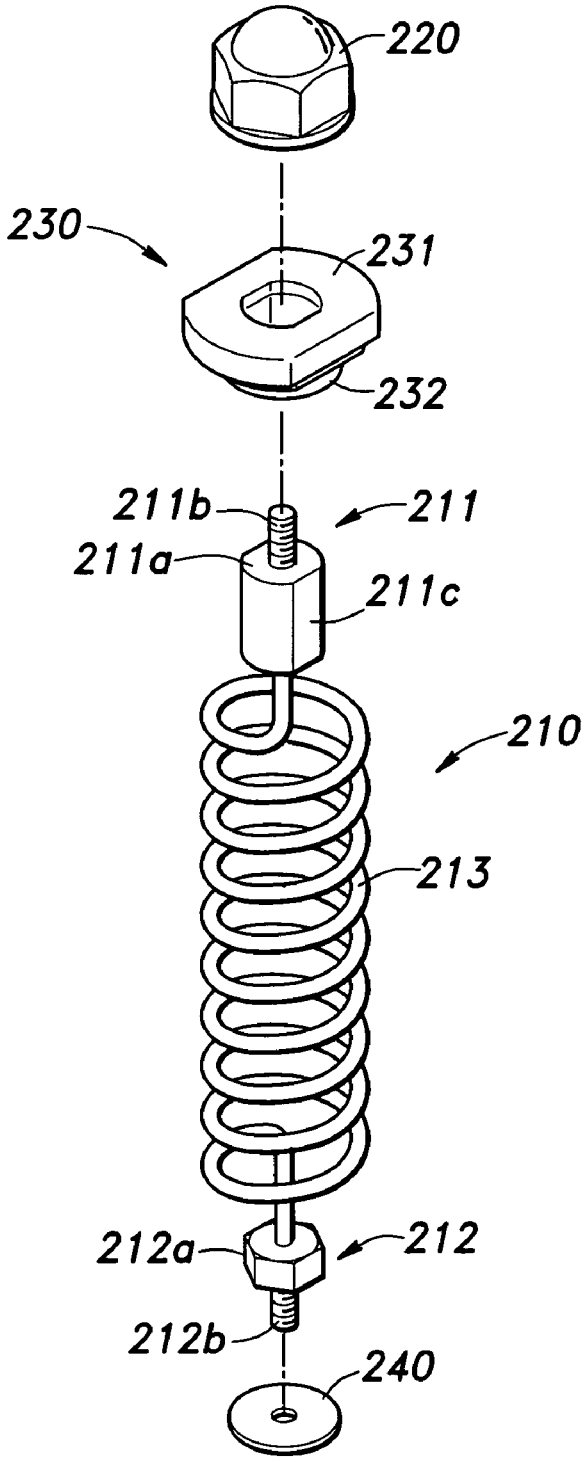
FIG. 17 is an exploded perspective view of the fastening mechanism that is used in the embodiment illustrated in FIG. 16.

Referring to FIG. 17, the fastening member 210 comprises a first threaded bolt 211 provided at one end, a second threaded bolt 212 provided at the other end, and a spring member 213 consisting of a tension coil spring. The first threaded bolt 211 consists of a substantially cylindrical base portion 211*a* and a threaded portion 211*b* which is coaxial with the cylindrical base portion 211*a* and reduced in diameter. The base portion 211*a* is provided with a pair of side faces 211*c* that are flat and parallel to each other.

The second threaded bolt 212 consists of a base portion 212*a* having a hexagonal cross section and a threaded portion 212*b* which is coaxial with the base portion 212*a*. The base portion 212*a* may be provided with other shapes as long as it may be engaged by a tool to turn it.

Figure 18A:
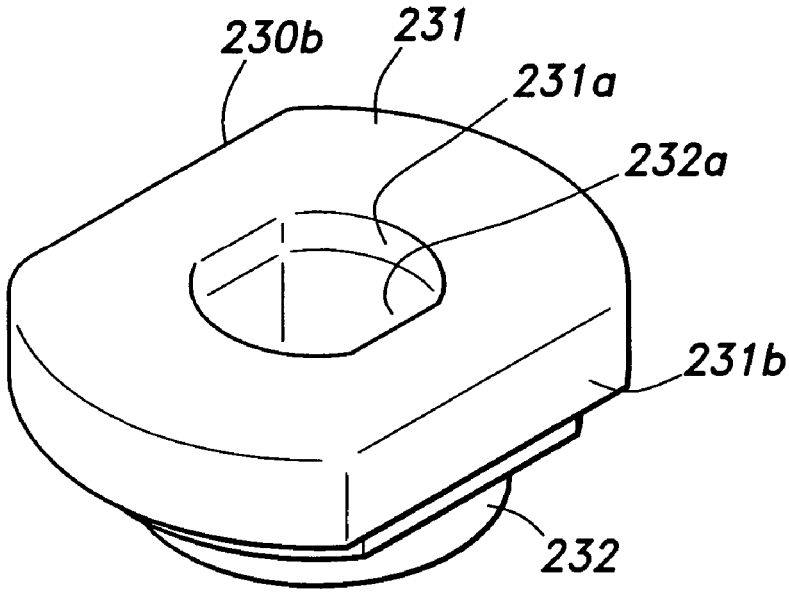
FIG. 18*a* is a perspective view of a part of FIG. 17.
Figure 18B:
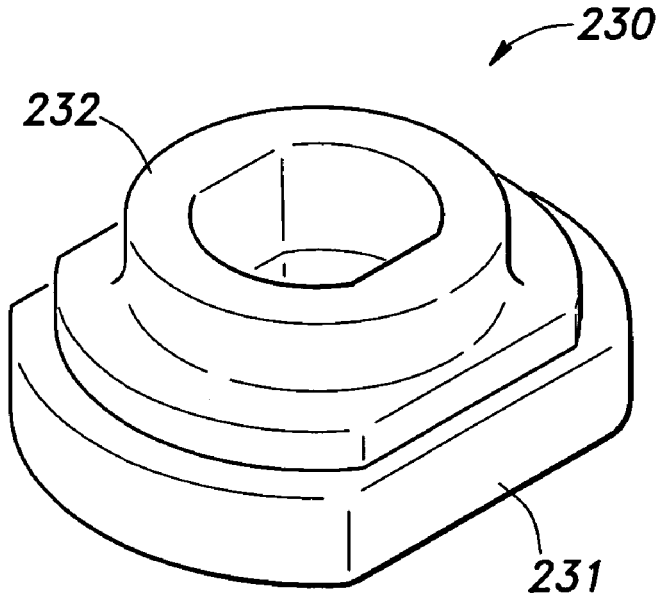
FIG. 18*b* is an inverted perspective view of the part shown in FIG. 18*b;*
Figure 19:
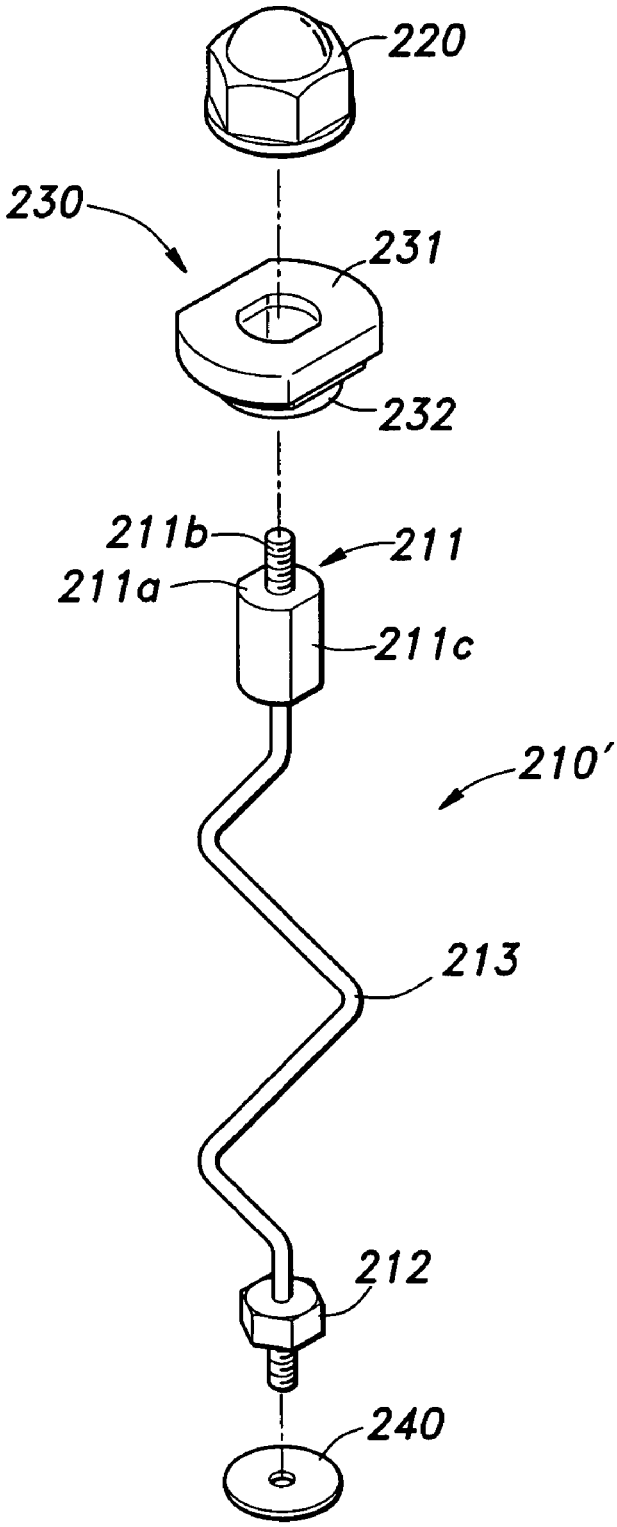
FIG. 19 is a modified fastening mechanism according to the present invention.

The spring member 213 joins the base portions 211*a* and 212*a* of the first and second threaded bolts 211 and 212. The spring member 213 may consist of a member that can provide a resilient reaction when extended, and is preferably made of readily deformable material such that the vibrations may be attenuated as they travel from one end to the other. Therefore, the spring member 13 may not be spiral as illustrated in FIGS. 17 and 18, but may also consist of a two-dimensional zig-zag shaped member, for instance, as illustrated in FIG. 19.

The fastening member 210 is used in combination with a nut 220, which in this embodiment consists of a cap nut, adapted to be threaded with the threaded portion 211*b* of the first threaded bolt 211, and a washer assembly 230 defining an inner opening 231*a*, 232*a* complementary in shape to the outer profile of the base portion 211*a* of the first threaded bolt 211. As illustrated in FIGS. 18*a* and 18*b*, the washer assembly 230 includes a washer main body 231 made of metal, plastic or other relatively hard material and a bush 232 that is made of rubber or other elasomeric material and integrally joined with the washer main body 231 in a coaxial relationship. The washer main body 231 and bush 232 jointly define the inner opening 231*a*, 232*a*. The outer periphery of the washer main body 231 is provided with a pair of mutually parallel straight edges 231*b*.

Figure 20:
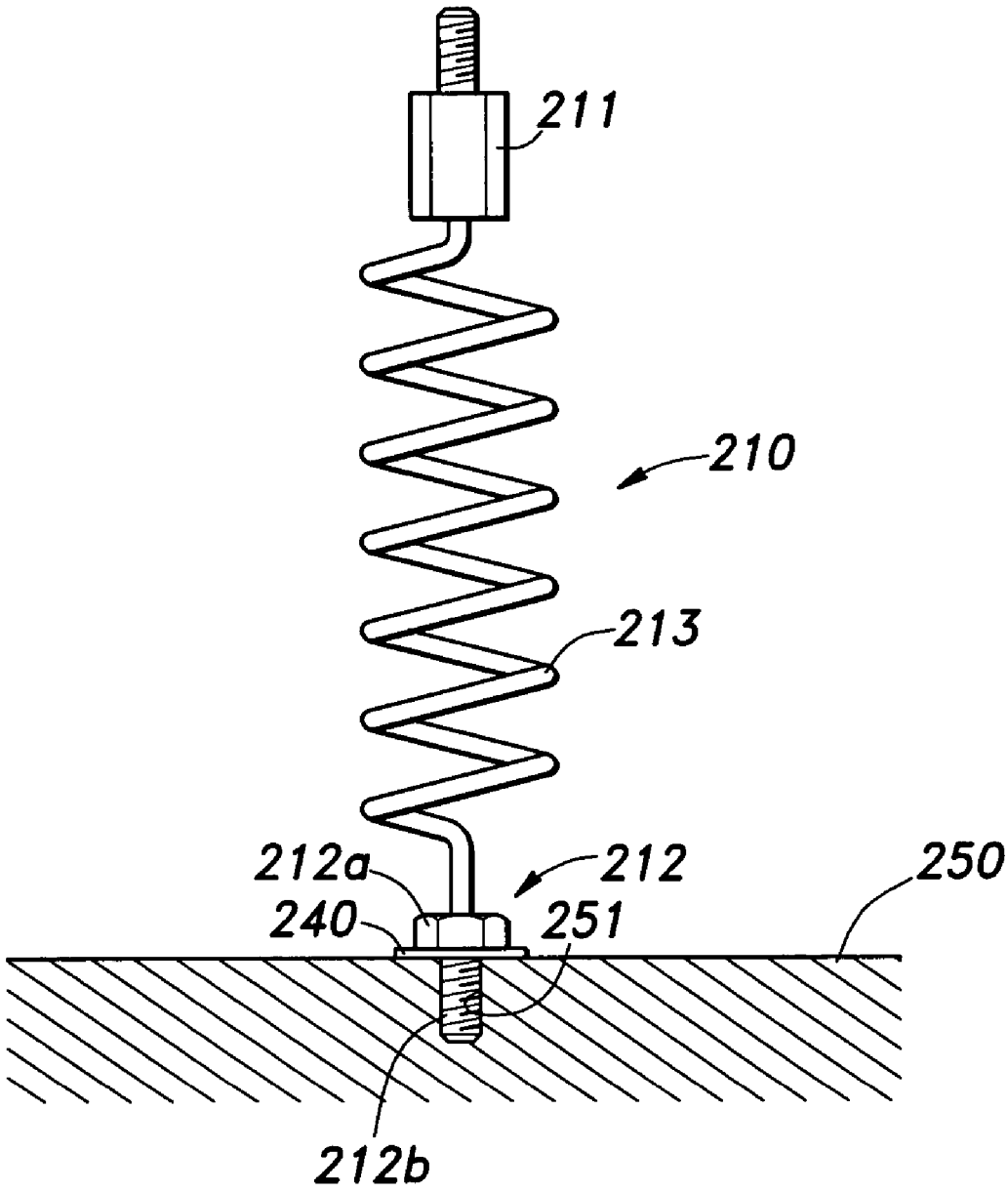
FIGS. 20 to 22 are sectional side views showing the mode of assembling the fastening mechanism of FIG. 17.

The mode of mounting the fastending member 210 is described in the following. Referring to FIG. 20, the threaded portion 212*b* of the second threaded bolt 212 is threaded into a threaded hole 251 formed in the cylinder head 250. Preferably, a washer 240 is interposed between the base portion 212*a* of the second threaded bolt 212 and opposing surface of the cylinder head 250.

Figure 21:
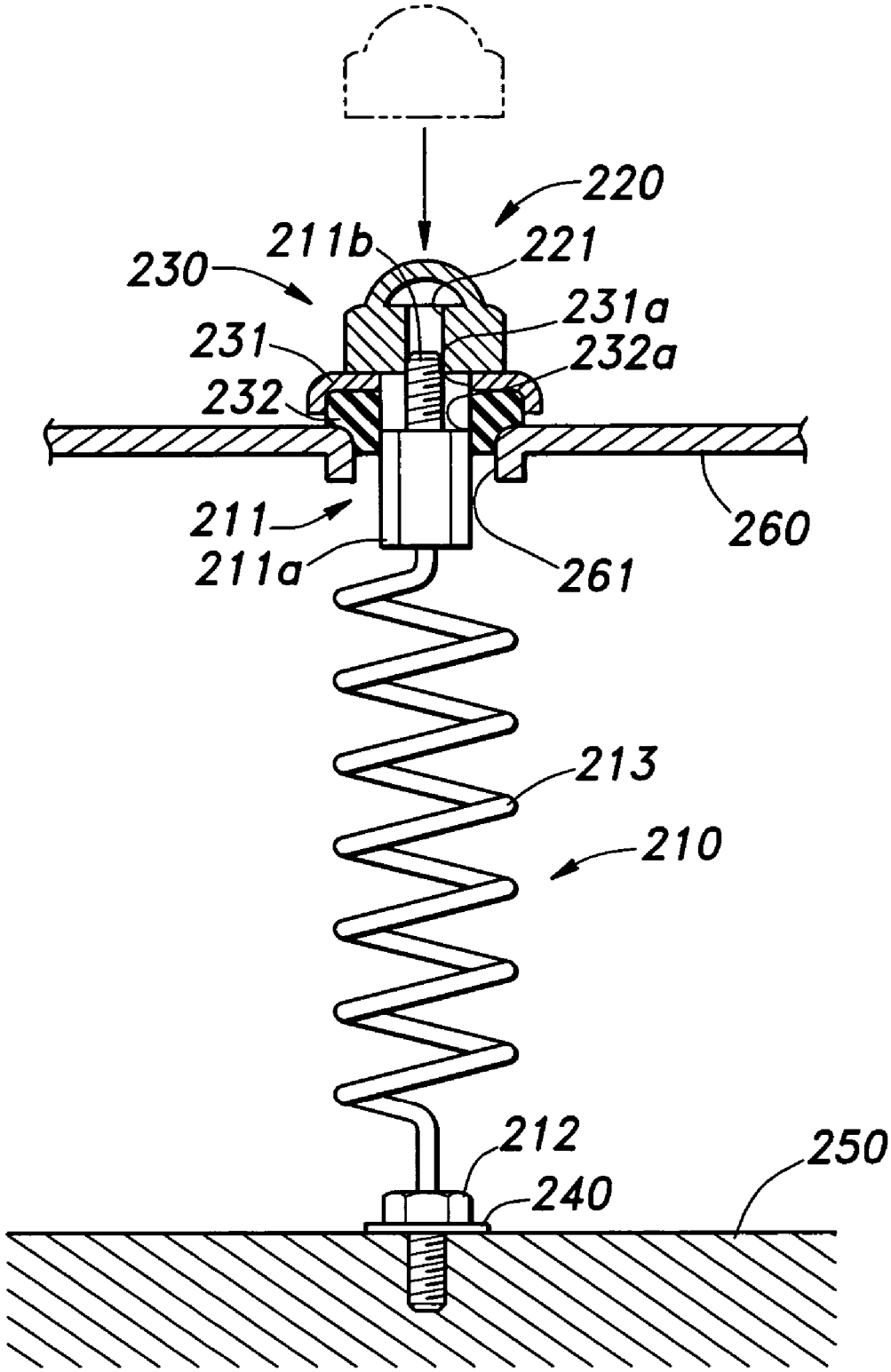
Figure 22:
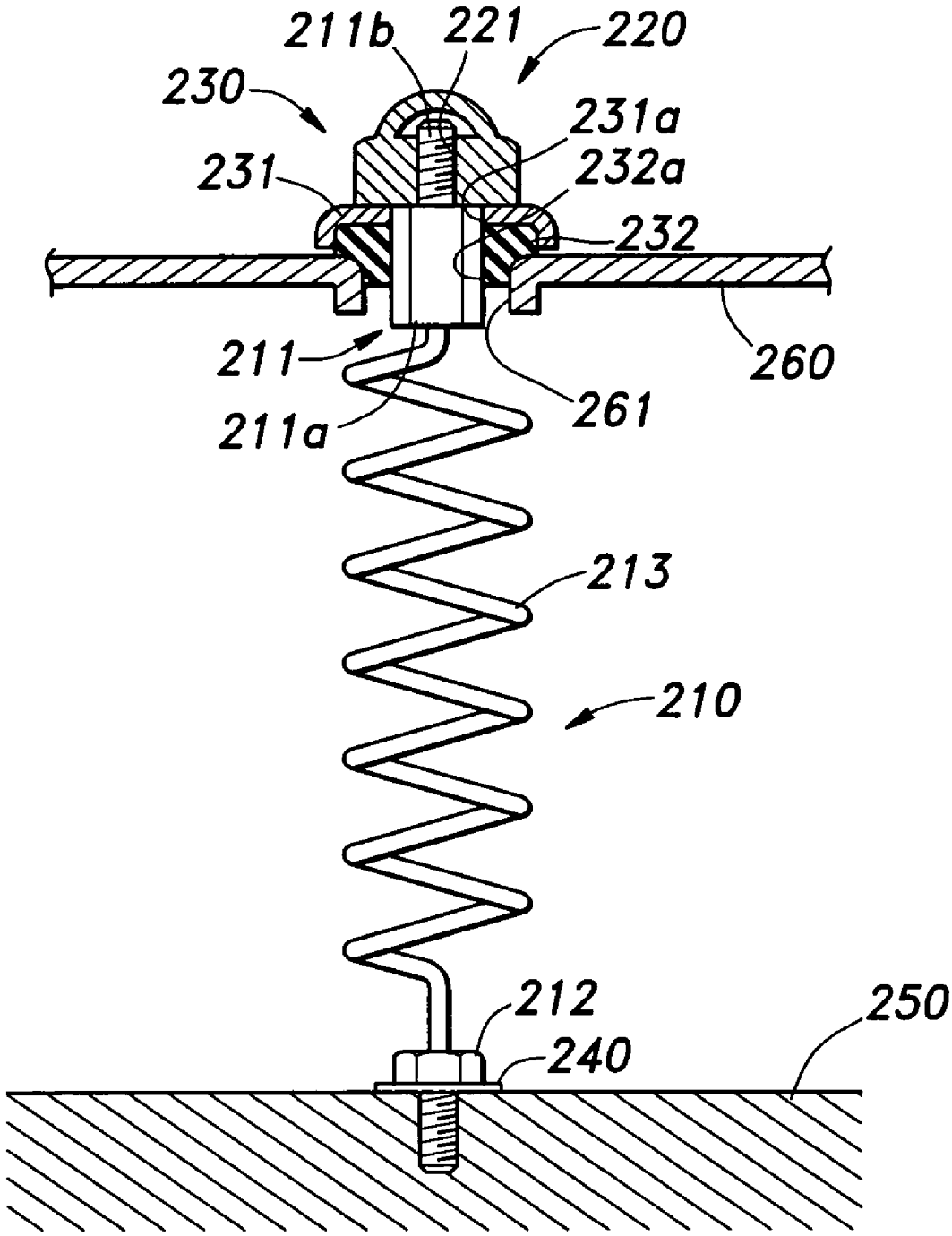

Referring to FIG. 21, the first threaded bolt 211 is passed through an opening 261 provided in the head cover 260, and the washer assembly 230 is fit on the base portion 211*a* of the first threaded bolt 211 from outside. The cap nut 220 is threaded with the threaded portion 211*b* of the first threaded bolt 211 while the straight edges 231*b* of the washer main body 230 are engaged by a suitable tool. Thus, the cap nut 220 can be fastened while the first threaded bolt 211 is prevented from turning.

As a result, the bush 232 having a larger diameter than the opening 261 of the head cover 260 provides both a cushioning function to the pressure of the washer main body 231 and a sealing function when the cap nut 220 is fully threaded with the threaded portion 211*b* of the first threaded bolt 211 and the spring member 213 is extended until a desired tension is produced in the spring member 213.

Figure 23:
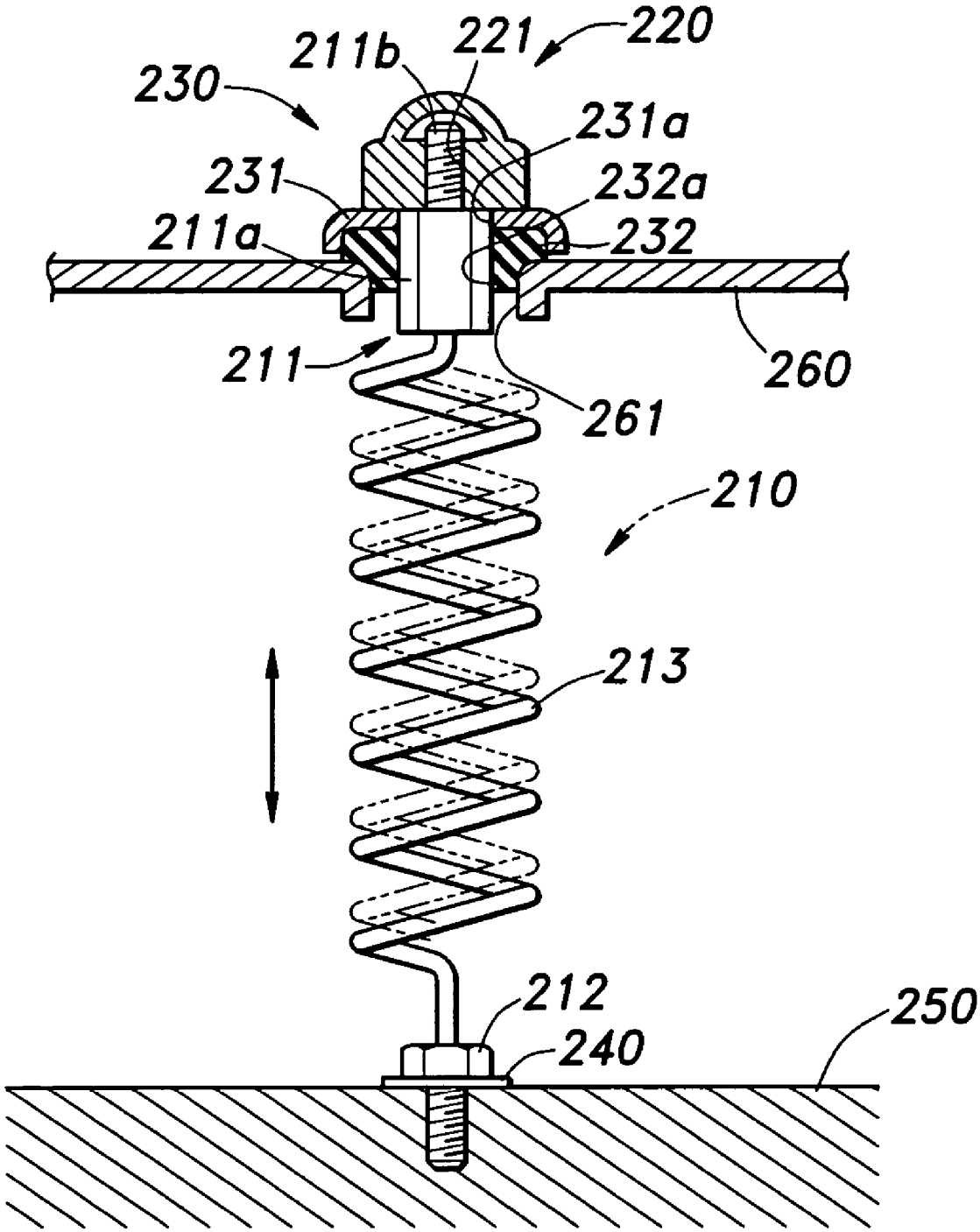
FIG. 23 is a sectional side view showing the mode of deformation of the fastening mechanism of FIG. 15.

If the fastening member is made of vibration control alloy, it can attenuate the vibrations even further. The fastening member may be entirely made of vibration control alloy or partially made of vibration control alloy. FIG. 23 shows how the vibrations are attenuated by the deflection of the spring member 10.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application(s) on which the Paris Convention priority claim is made for the present application are incorporated in this application by reference.

The invention claimed is:

1. A vibration control arrangement for a valve actuating mechanism of an internal combustion engine, the valve actuating mechanism comprising a cam holder fixedly attached to a cylinder head and a camshaft formed with a cam for actuating an engine valve rotatably supported by the cam holder, wherein: a vibration control member made of vibration control alloy is interposed in a path of vibration transmission between the camshaft and the cylinder head, wherein the cam holder comprises a lower cam holder attached to the cylinder head and an upper cam holder attached to the lower cam holder to define a bearing bore jointly with the lower cam holder, the vibration control member being interposed in a parting plane between the upper and lower cam holder.

2. A vibration control arrangement according to claim 1, wherein the vibration control member is interposed between the cam holder and cylinder head.

3. A vibration control arrangement according to claim 1, wherein the cam holder is secured to the cylinder head by using threaded bolts, and the vibration control member is interposed between a head of each threaded bolt and an opposing surface of the cam holder.

4. A vibration control arrangement according to claim 1, further comprising a rocker shaft supported by the cam holder and a rocker arm rotatatively supported by the rocker shaft to transmit a rotational movement of the cam to reciprocating movement of a valve stem of an engine valve, the vibration control member is fit into the cam holder so as to surround the rocker shaft.

5. A vibration control arrangement according to claim 4, wherein the rocker arm is provided with an adjust screw by which the rocker arm engages the valve stem, and the adjust screw is supported by the rocker arm via the vibration control member.

6. A vibration control arrangement according to claim 1, further comprising a rocker arm having a pivot end pivotally supported by the cylinder head, an actuating end engaging a valve stem of an engine valve and an intermediate cam follower portion engaged by the cam, the pivot end cooperating with a pivot member supported by the cylinder head via the vibration control member.

7. A vibration control arrangement according to claim 1, further comprising a rocker arm having a pivot end pivotally supported by the cylinder head, an actuating end engaging a valve stem of an engine valve and an intermediate cam follower portion engaged by the cam, the pivot end being provided with a pivot member supported by the rocker arm via the vibration control member.

8. A vibration control arrangement according to claim 1, wherein the valve actuating mechanism comprises a variable lift mechanism.

9. A vibration control arrangement according to claim 8, wherein the variable lift mechanism comprises a rocker shaft supported by the cam holder, a rocker arm rotatatively supported by the rocker shaft to transmit a rotational movement of the cam to reciprocating movement of a valve stem of an engine valve and an actuating shaft rotatably supported by the cam holder for changing a configuration of the rocker arm, the vibration control members being fit into the cam holder so as to surround the rocker shaft and actuating shaft.

10. A vibration control arrangement according to claim 1, further comprising a head cover that is attached to the cylinder head to accommodate the valve actuating mechanism therein and fastening members for securing the head cover to the cylinder head, the fastening members being made of vibration control alloy.

11. A vibration control arrangement for a crankshaft mechanism of an internal combustion engine, the crankshaft mechanism comprising a crankshaft rotatably supported by a cylinder block via a bearing member, wherein: at least a part of the bearing member surrounding a journal of the crankshaft is made of vibration control alloy, wherein the bearing member is a rectangular block having a semi-cylindrical bearing surface.

12. A vibration control arrangement according to claim 11, wherein the bearing member is cast in the cylinder block.

* * * * *